United States Patent [19]

Rode et al.

[11] 3,973,110

[45] Aug. 3, 1976

[54] CIRCULATING SHIFT REGISTER TIME-KEEPING CIRCUIT

[75] Inventors: France Rode, Los Altos; Eric A. Slutz, Palo Alto, both of Calif.

[73] Assignee: Hewlett-Packard Company, Palo Alto, Calif.

[22] Filed: July 26, 1974

[21] Appl. No.: 492,303

[52] U.S. Cl. ..... 235/152; 58/23 R

[51] Int. Cl.[2] ..... G04C 3/00

[58] Field of Search ..... 235/168, 156, 152; 58/23 R

*Primary Examiner*—David H. Malzahn

*Attorney, Agent, or Firm*—F. David LaRiviere

[57] ABSTRACT

The circulating shift register time-keeping circuit of the present invention comprises five circulating shift registers and controller and time base circuits to provide real-time, stopwatch, date and alarm functions to an eight-digit display means via a display register. The real-time, stopwatch and date registers each include a binary adder, adder controller and auxiliary register coupled to clocked delay elements. The alarm register includes a comparator coupled to similarly clocked delay elements. Timing and command signals are provided to the five shift registers from the time base and controller, respectively.

11 Claims, 11 Drawing Figures

CIRCULATING SHIFT REGISTER TIME-KEEPING CIRCUIT

BACKGROUND OF THE INVENTION

Prior art electronic time-keeping devices, whether wristwatch, wall-mount or table-top clocks, have employed frequency divider methods of time-keeping, wherein the output signal of a stable crystal oscillator is repetitively divided to an appropriate lower frequency and applied to switching, logic and decoding circuits for display to the user as real-time. The calendar date is included in some of these devices such as the one described in U.S. Pat. No. 3,803,834. The same basic circuitry is also used to construct electronic stopwatches.

Frequency divider circuits require as many data lines and decoders as there are dividers to display the data. Thus there is no single data line from which time data can be accessed. Furthermore, for alarm circuits, a plurality of comparators are required. Because of the multiplicity of lines from which the time data must be accessed and the commensurate amount of additional circuitry required use of the data for other purposes such as real-time speed and distance calculations is more difficult.

SUMMARY OF THE INVENTION

The present invention comprises five circulating shift registers (CSR's), time base and controller circuits and display. Time data for real-time, split times (i.e. time intervals measured by stopwatches) and calendar dates circulates in serial format in a separate CSR for each of the above-named time units. The data is available via a single access line from each CSR. Since the data is in serial form, only one comparator is required for the alarm register.

The real-time, stopwatch and calendar date CSR's have a binary adder, adder controller and auxiliary register coupled to 32 serially-connected, clocked delay elements. The auxiliary register includes three delay elements, also clocked and serially connected. The alarm CSR includes a comparator coupled to 32 serially-connected and clocked delay elements. Original time data for setting the real-time and date register is entered via the display register. Time data from the CSR's for display is transmitted to the display via the display register. The time base and controller comprise logic gates and flip-flops which provide timing and command signal respectively, to the five CSR's and the display means.

Real-time data is available for 8 digits of display, 1 digit each for hundredths-of-seconds (.01 seconds), tenths-of-seconds (0.1 seconds), seconds (1.0 seconds), tens-of-seconds (10 seconds), minutes (1.0 minutes), tens-of-minutes (10 minutes), hours (1.0 hours) and tens-of-hours (10 hours). Splits may be displayed as described for real-time data or as 6 digits of seconds units and 1 digit of hundredths-of-seconds and 1 digit of tenths-of-seconds. Calendar dates comprise a 6 digit display, 2 digits each for day of the months, month of the year and year of the century without century designation. A seventh digit is used for numerically indicating the day of the week relative to a first day assignable by the user.

The 8-digit display comprises 32 bits of time data, each digit comprising a 4-bit data word. When the value of the data word in the auxiliary register is 10, and that data word represents the 0.01, 0.1, 1.0 seconds, the 1.0 minutes or the 1.0 hours digits, a one is carried to the 0.1, 1.0, 10 seconds, the 10 minutes or the 10 hours digits, respectively. The carry is performed by the adder controller according to conventional rules of addition. However, a one must be carried when the 10 seconds and 10 minutes digits reach a value of 6. The mode setting determines when a one must be carried from the 1.0 hour digit to the 10 hour digit, and when the 10 hour digit is reset to zero upon reaching a value of 2 or 3.

DESCRIPTION OF THE PREFERRED EMBODIMENT

Figure 1:
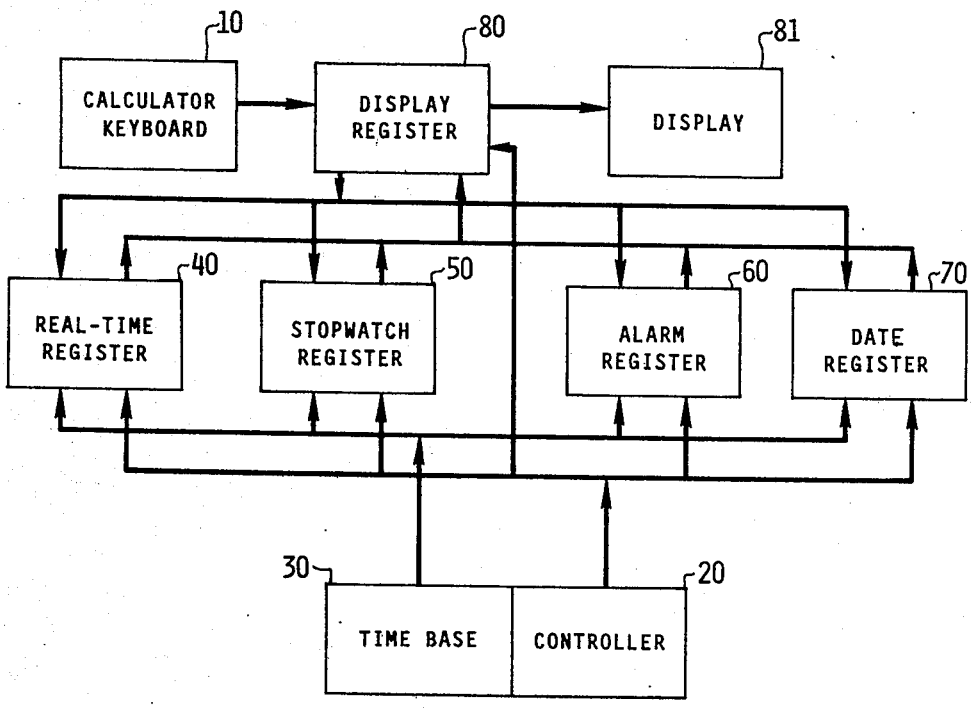
FIG. 1 is a block diagram of an electronic time-keeping circuit according to the preferred embodiment of the present invention.

Referring to FIG. 1, CSR's 40, 50, 60 and 70 receive timing and command signals from time base 30, and controller 20, respectively. Real-time register 40 and date register 70 receive original time data for setting these CSR's to the correct time and date, and all CSR's output time data for display to the user via display register 80.

Figure 2A:
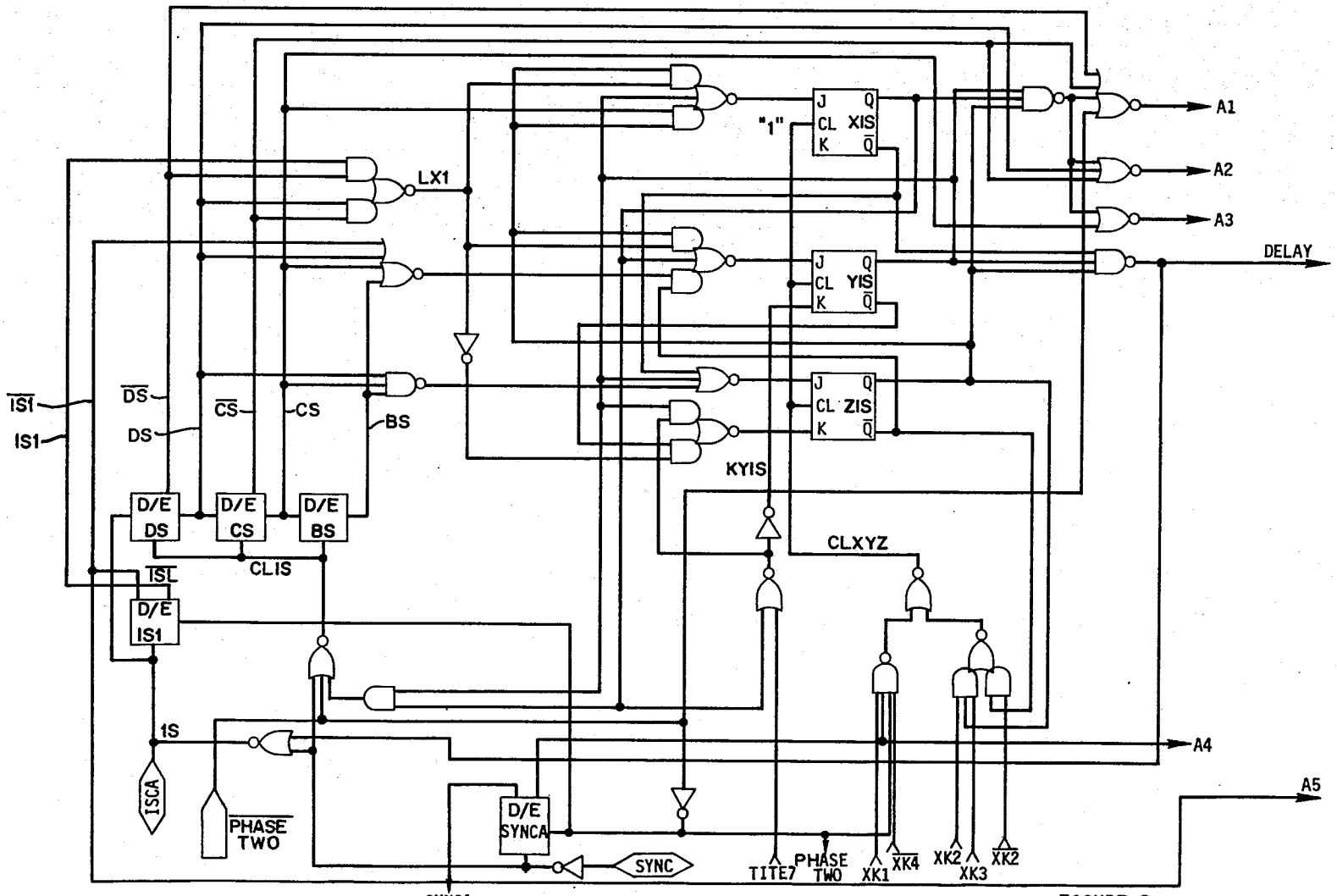
FIGS. 2A and 2B is a logic diagram of an electronic calculator interface circuit and the controller of the time-keeping circuit of FIG. 1.
Figure 2B:
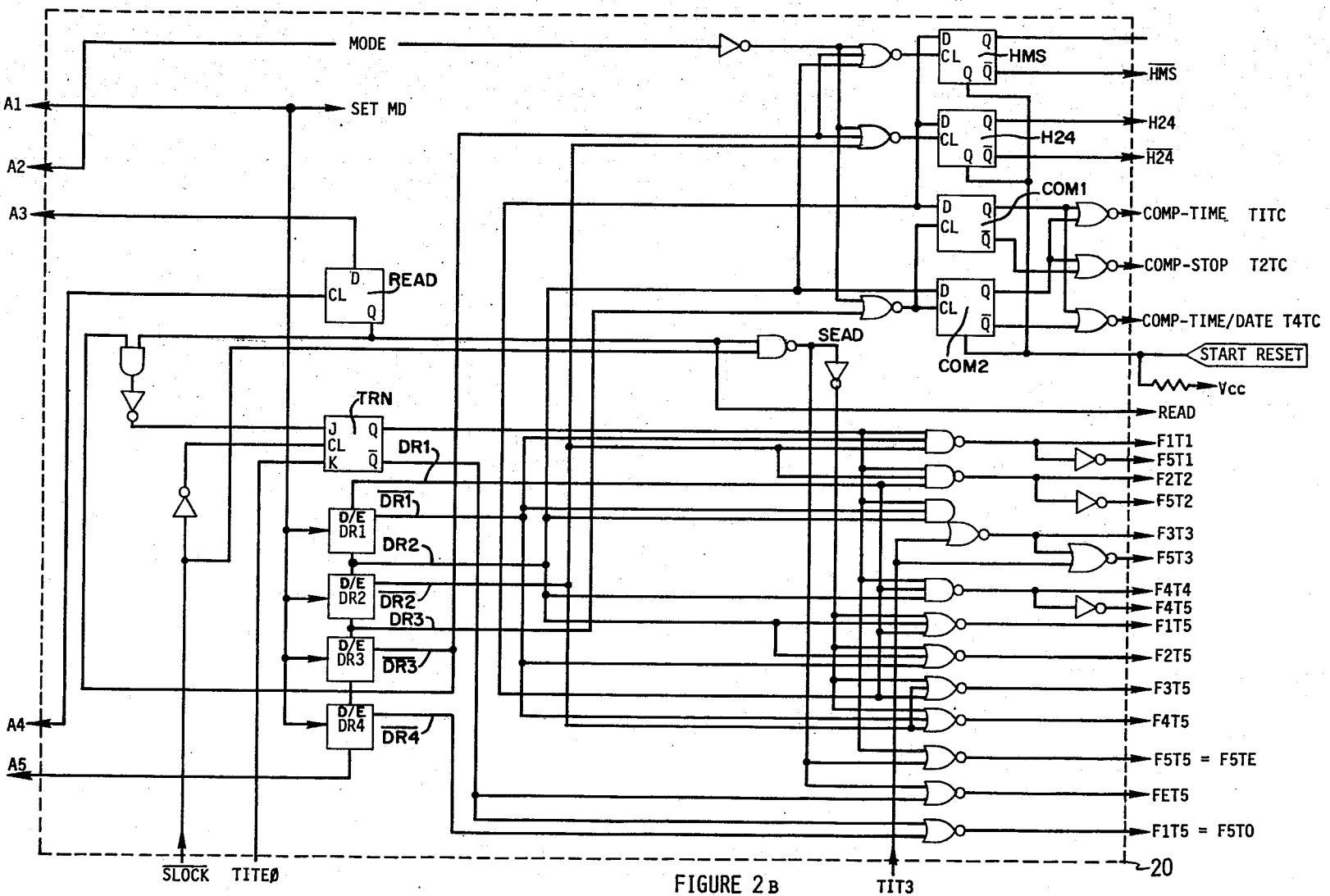

FIGS. 2A and 2B shows one embodiment of controller 20. Any embodiment which provides the command signals defined by the logic equations given in Table I is adequate to control the time-keeping circuit of the present invention. The preferred embodiment of this invention is capable of stand-alone operation or operation in combination with an electronic calculator. FIGS. 2A and 2B also includes one embodiment of an interface to the calculator with which the time-keeping circuit of the present invention is designed to work. Any interface circuit can be used so long as appropriate signals are provided to *ff*'s DREAD, TRN, DR1, DR2, DR3 and DR4 of controller 20 to enable it to provide the command signals defined in Table I.

Table I

| Controller Logic Equations | |
|---|---|
| IS | $= ISCA+\overline{SYNC+DELAY}$ |
| LX1 | $= \overline{IS1.DS+DS.CS}$ |

Table I-continued

| Controller Logic Equations | |
|---|---|
| JXIS | = $\overline{LX1.ZJS+YIS+CS.ZIS}$ |
| KXIS | = $\overline{1}$ |
| JYIS | = $\overline{ZIS.LX1+XIS+ZIS.IS1.DS.CS.BS}$ |
| KYIS | = $\overline{XIS+TITE7}$ |
| JZIS | = $\overline{XIS+YIS+DS.CS.BS}$ |
| KZIS | = $\overline{YIS.KYIS+YIS.LX1}$ |
| CLXYZ | = $\overline{SYNCA.XK1.XK4.PHASETWO+XK2.XK3.ZIS+ZIS\ XK2}$ |
| CLIS | = $\overline{SYNC+PHASETWO+XIS.YIS}$ |
| SETMD | = $\overline{DS+CS+YIS.ZIS.XIS+PHASETWO}$ |
| MODE | = $\overline{YIS.ZIS.XIS+DS+CS}$ |
| DREAD | = $\overline{YIS.ZIS.XIS+CS}$ |
| DELAY | = $\overline{XIS.YIS.ZIS}$ |
| JTRN | = $\overline{READ.DR3}$ |
| KTRN | = TITEØ |
| CLTRN | = SLOCK |
| DHMS | = $\overline{DR1}$ |
| CLHMS | = $\overline{MODE+DR3+DR2}$ |
| DH24 | = $\overline{DR1}$ |
| CLH24 | = $\overline{MODE+DR3+DR2}$ |
| DCOM1 | = DR1 |
| DCOM2 | = $\overline{DR2}$ |
| CLCOML | = $\overline{MODE+DR3}$ |
| SEAD | = $\overline{READ.SLOCK}$ |
| T1TC | = $\overline{COM1+COM2}$ |
| T2TC | = $\overline{COM1+COM2}$ |
| T4TC | = $\overline{COM1+COM2}$ |
| F1T1 | = TRN.$\overline{DR1.DR2}$ |
| F5T1 | = $\overline{F1T1}$ |
| F2T2 | = $\overline{TRN.DR1.DR2}$ |
| F5T2 | = $\overline{F2T2}$ |
| F3T3 | = $\overline{TRN.DR1.DR2+F1T3}$ |
| F5T3 | = $\overline{F3T3+F1T3}$ |
| F4T4 | = $\overline{TRN.DR1.DR2}$ |
| F4T5 | = $\overline{F4T4}$ |
| F1T5 | = $\overline{SEAD+DR1+DR2}$ |
| F2T5 | = $\overline{SEAD+DR1+DR2}$ |
| F3T5 | = $\overline{SEAD+DR1+DR2}$ |
| F4T5 | = $\overline{SEAD+DR1+DR2}$ |
| F5T5 | = F5TE = $\overline{TRN+SEAD}$ |
| FET5 | = $\overline{SEAD+TRN}$ |
| FIT5 | = F5TO = $\overline{TRN+DR4}$ |

DELAY ELEMENTS

IS1 CLOCKED BY PHASE TWO
SYNCA CLOCKED BY PHASE TWO
DS, CS, BS CLOCKED BY CLIS
DR1, DR2, DR3, DR4 CLOCKED BY SETMD

D FLIP-FLOPS

HMS CLOCKED BY CLHMS
H24 CLOCKED BY CLH24
COM1 CLOCKED BY CLCOM1
COM2 CLOCKED BY CLCOM1

JK FLIP-FLOPS

TRN CLOCKED BY SLOCK
XIS, YIS, ZIS CLOCKED BY CLXYZ

Figure 3A:
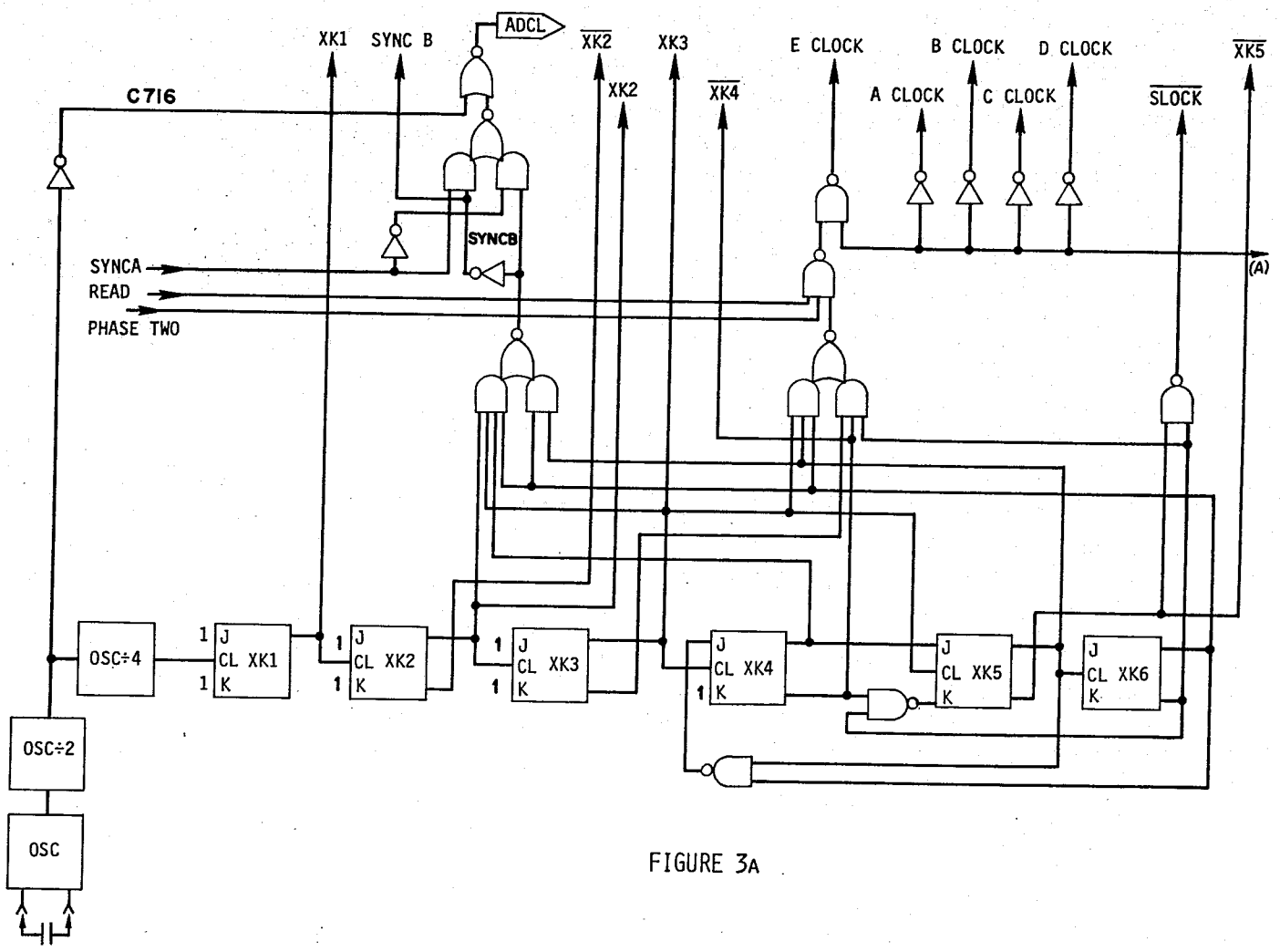
FIGS. 3A and 3B is a logic diagram of the time base of the timekeeping circuit of FIG. 1.
Figure 3B:
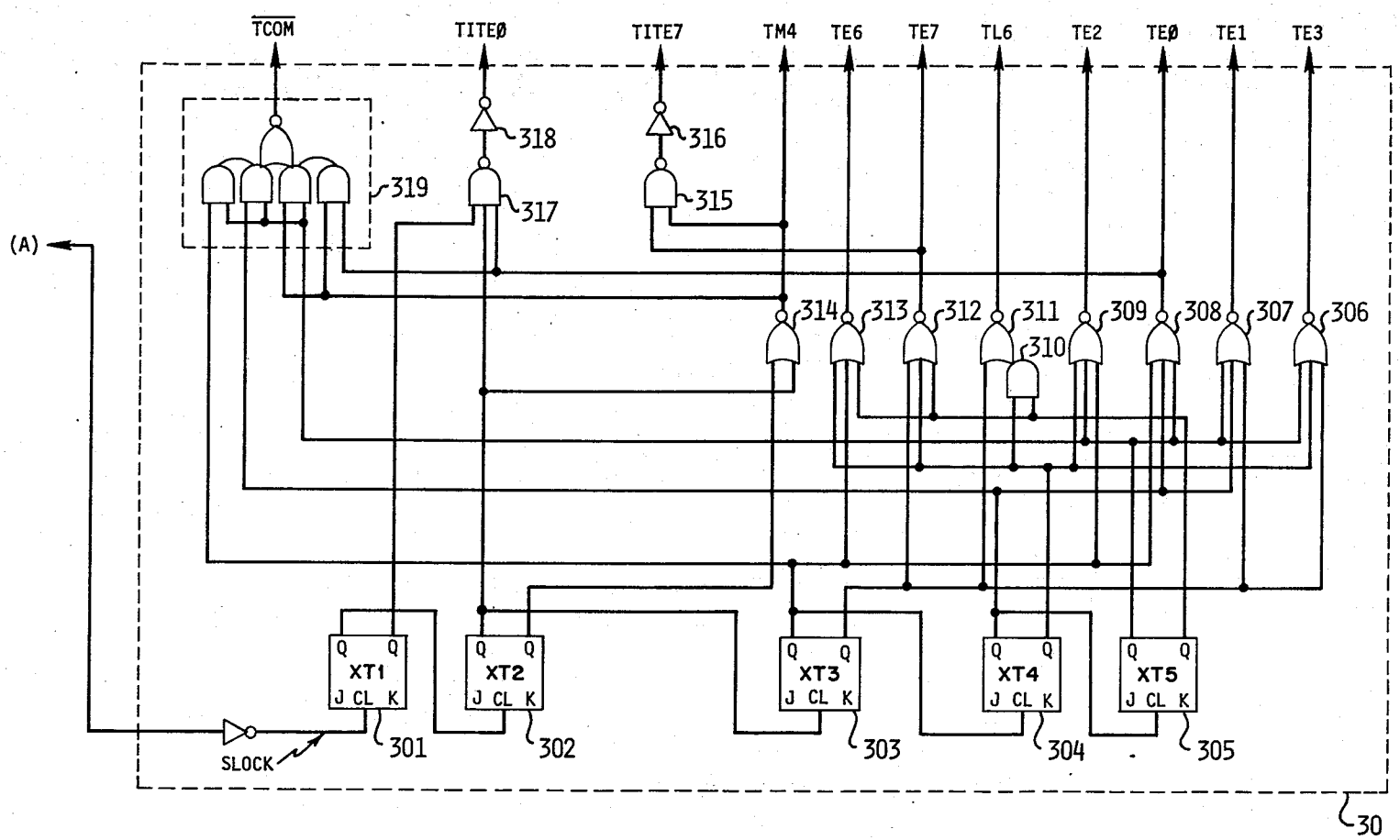
Figure 3C:
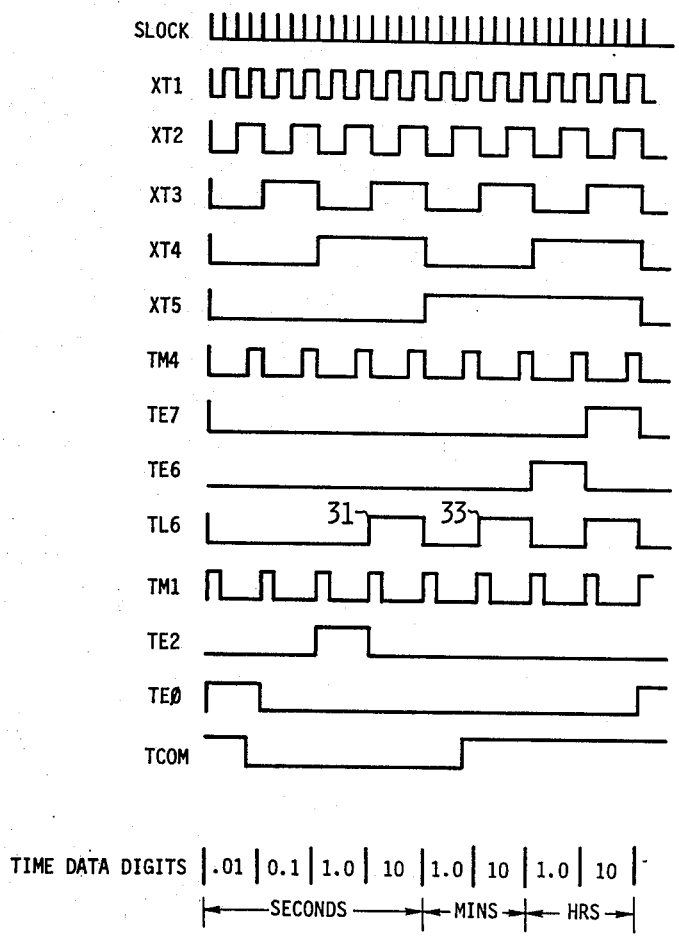
FIG. 3C is a diagram of the timed command signals provided by the timing circuit of FIG. 3.

Referring to FIGS. 3A and 3B the circuit shown includes time base 30 for the preferred embodiment of the present invention, wherein an accurate and stable 3.2 KHz oscillatory signal, hereinafter referred to as SLOCK, is applied to frequency divider flip-flops 301, 302, 303, 304 and 305. SLOCK is also the clock pulse used to clock the delay elements of the CSR's. The time base provides timing signals to the registers and calculator interface circuit which are developed by the frequency divider flip-flops. The timing signals, defined by the logic equations given in Table II, are then transmitted to the registers after processing by logic elements 306 through 319. FIG. 3C shows these timing signals relative to one another and to the units of time they affect. Flow of time data and timing signals in the CSR's will be more fully described in connection with the description of the real-time register.

Table II

| Time Base Logic Equations | |
|---|---|
| ECLOCK | = $\overline{READ.PHASETWO.XK3.XK5.XK6+XK3.XK4.XK6.SLOCK}$ |
| ACLOCK | = $\overline{SLOCK}$ |
| BCLOCK | = $\overline{SLOCK}$ |
| CCLOCK | = $\overline{SLOCK}$ |
| DCLOCK | = $\overline{SLOCK}$ |
| TM4 | = $\overline{XT1+XT2}$ |
| TE6 | = $\overline{XT3+XT4+XT5}$ |
| TE7 | = $\overline{XT3+XT4+XT5}$ |
| TL6 | = $\overline{XT3+XT4.XT5}$ |
| TE2 | = $\overline{XT3+XT4+XT5}$ |
| TE0 | = $\overline{XT3+XT4+XT5}$ |
| TE1 | = $\overline{XT5+XT4+XT3}$ |
| TE3 | = $\overline{XT5+XT4+XT3}$ |
| TCOM | = TE0.TM4+TM4.XT5+XT5.XT3+XT5.XT4 |
| JK FLIP-FLOP: | |
| XT1 | CLOCKED BY SLOCK |
| XT2 | CLOCKED BY XT1 |
| XT3 | CLOCKED BY ST2 |

Table II-continued

| Time Base Logic Equations | |
|---|---|
| XT4 | CLOCKED BY XT3 |
| XT5 | CLOCKED BY XT4 |

Figure 4:
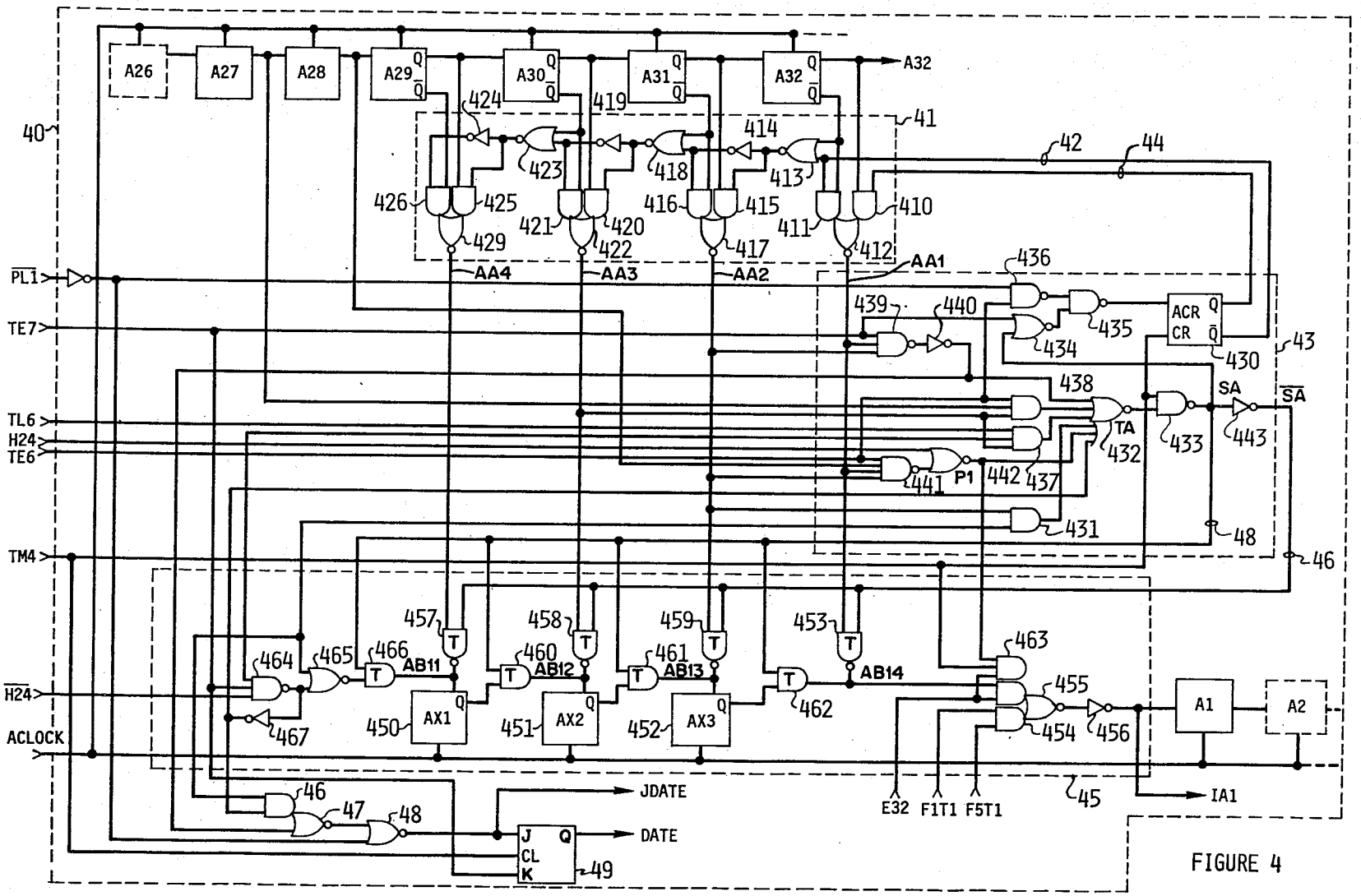
FIG. 4 is a logic diagram of the real-time register of the time-keeping circuit of FIG. 1.

Referring to FIG. 4, real time register 40 comprises delay elements A1 through A32, binary adder 41, adder controller 43 and auxiliary register 45. Delay elements A1 through A32 may be conventional, clocked flip-flops (ff's) or the same or similar to those described in U.S. Pat. application Ser. No. 468,958 entitled "A Circulating Shift Register Memory Having Editing and Subroutining Capability", filed May 10, 1974 by Chung C. Tung and which is assigned to the assignee hereof. Binary adder 41 includes a plurality of AND gates, NOR gates and inverters connected as shown to accept time data from delay elements A29 through A32 and to combine that data with data from adder controller 43 via data lines 42 and 44. Adder controller 43 also includes AND gates, NOR gates and inverters in addition to NAND gates and ff 430, connected as shown to accept timing and command signals from time base 30 and controller 20, respectively, and to monitor the output of and to provide carry data to, binary adder 41. Adder controller 43 also provides information to auxiliary register 45 for further processing of each digit code after processing thereof by binary adder 41. Auxiliary register 45 includes three delay elements 450, 451, 452 AND, NAND, and NOR gates and inverters connected as shown to provide intermediate storage of 3 bits of each digit of time data as it circulates in the CSR. Operation of auxiliary register 45 is described more fully below.

In operation, real-time data circulates in serially connected delay elements A1 through A32 at a 3.2 KHz rate, i.e., one circulation every 0.01 second. With every complete circulation of the CSR, the data word representing the 0.01 second digit is incremented by binary adder 41 when the 4 bits of that data word are transferred from delay elements A29 through A32 to AX1, AX2, AX3, and A1, respectively. It should be noted that the rate at which the time data is incremented may be selected to suit the frequency of circulation in the CSR.

The operation of binary adder 41 will be described with reference to FIGS. *3a* and 4 and in terms of positive logic signal convention. Assuming the data word representing the 0.01 second digit is zero, a zero appears at the Q output of delay elements A29 through A32. During each positive pulse in timing signal TM4, the Q output of carry flip-flop 430 is a one, the output of gate 410 is a zero. Since the $\overline{Q}$ output of ff 430 is a zero and the $\overline{Q}$ output of A32 is a one, the output of gate 411 is also a zero. Since both inputs of gate 412 are zero, the output thereof, which is the first bit of the 4-bit data word representing the 0.01 seconds digit is now a one. That bit is then transmitted to A1 via gates 453, 454 and 455 and inverting amplifier 456. Recalling that a zero appears at the Q output of A31, a zero appears at the output of gate 415 since the output of gate 413 is also a zero. The output of gate 413 is a zero because the $\overline{Q}$ output of A32 is a one and the $\overline{Q}$ output of ff 430 is a zero. Since the $\overline{Q}$ output of A31 is a one and the output of inverting amplifier 414 is a one, the output of gate 416 is also a one. Thus, the output of gate 417 is a zero since the inputs thereof are not alike.

The outputs of gates 422 and 427 are also zero by similar analysis. Since the Q output of A30 and the output of gate 418 are zero, the output of gate 420 is also a zero. Conversely, the output of gate 421 is a one because the $\overline{Q}$ output of A30 and the output of inverting amplifier 419 are also a one. Therefore the output of gate 422 is a zero since the inputs thereof are not alike. Similarly, since the Q output of A29 and the output of gate 423 are both zero, the output of gate 425 is a zero, and the output of gate 426 is a one because the Q output of A29 and of output inverting amplifier 424 are also one. Hence, the output of gate 427 is a zero.

No carry to the next 4-bit data word is generated until the data word representing the 0.01 digit is incremented to a binary value of ten, which is 1010 in binary format. Until then, the binary value of that data word continues to increment in the manner just described. However, when 1, 0, 1 and 0 appear at the outputs of gates 427, 422, 417 and 412, respectively, (hereinafter referred to as the output of binary adder 41) at TM4, carry ff 430 is preset by adder controller 43 to increment the 0.1 seconds digit as follows: the output of detector gate 431 is a one since both inputs are also ones; since the output of gate 432 is a zero when any one of the inputs thereof is a one, the output of gate 433 is a one because the inputs thereof are not alike at TM4; the output of gate 434 is a zero because the one output of gate 433 is applied to one input at the same time TE7 is applied to the other input; and the output of gate 435 is a one since the output of gate 436 is a zero if and only if both inputs are ones.

When the binary word representing the 0.1 and 1.0 seconds, the 1.0 minutes and the 1.0 hours digits reaches a value of ten, carry ff 430 is preset to increment the 1.0 and 10 seconds, 10 minutes and 10 hours digit, respectively, in substantially the same manner as that described above for incrementing the data word representing the 0.1 seconds digit. When the binary data word representing the 10 seconds and the 10 minutes digits reaches a value of six at time TL6 (i.e. pulses 31 and 33, respectively, of timing signal TL6), detector gate 437 applies a one to one input of gate 432 and carry preset ff 430 is preset to increment the 1.0 minute and 1.0 hour digits, respectively. The logical flow of data from the output of gate 437 to ff 430 is substantially the same as that already described for incrementing the data word representing the 0.1 seconds digit and will not be repeated here.

The preferred embodiment of this invention may be set to operate in either a 12 hour or 24 hour mode. For operation in a 24 hour mode, the 1.0 and 10 hour digits must be incremented and reset differently than for operation in a 12 hour mode. Referring again to FIGS. *3a* and 4, detector gate 438 applies a one to gate 432 when, at the time TE6 (i.e., the positive pulse of timing signal TE6), the binary data word representing the 1.0 hour digit at the output of binary adder 41 reaches a value of four at the same time the value of the next data word representing the 10 hour digit is two (i.e., the Q output of A27). At this time, a one is applied to all three inputs of detector gate 438, and the logical flow of data from the output thereof to ff 430 is the same as described above for incrementing the data word representing the 0.1 seconds digit. Carry ff 430 is now preset to increment the data word representing the 10 hours digit to a value of three. When the 10 hours digit is incremented to a value of three at time TE7 (i.e. the positive pulse of timing signal TE7), the output of detector gate 439 is a zero since a one is applied to all three inputs thereof. The output of gate 431 becomes a one after inversion by inverting amplifier 440, and the logical flow of data therefrom to ff 430 is the same as described above. The binary data words representing the 1.0 and 10 hours digits are reset to zero by auxiliary register 45 which is described below.

For operation in the 12 hour mode, detector gate 441 monitors the output of binary adder 41 for a data word having a value of three followed by a data word having a value of one (i.e. the output of A28) at time TE6. The zero output of gate 441 is applied to gate 442 which provides a one to gate 432, whereas the output of gate 442 is a zero for 24 hour mode operation. Auxiliary register 45 resets the value of the data word representing the 1.0 hour digit to a value of one and the value of the data word representing the 10 hour digit to zero as described below.

The output of binary adder 41 is transmitted to A1 via auxiliary register 45 at every occurrence of a positive pulse of timing signal TM4 whether or not carry ff 430 is preset to add one to the next digit. Auxiliary register 45 receives the time data in parallel, wherein the output of gates 427, 422 and 417 is applied to delay elements AX1, AX2 and AX3 via gates 457, 458 and 459, respectively. The output of gate 412 is transmitted to A1 as mentioned above. Since the output of gates 457, 458 and 459 is a one if and only if both inputs are one, inverting amplifier 443 controls the time data value received by the delay elements of auxiliary register 45 and Al at TM4.

A positive pulse in timing signal TM4 occurs every fourth SLOCK pulse, SLOCK being the basic timing signal applied to CSR delay elements. Therefore, for three SLOCK pulses after time data is received by auxiliary register 45, no new data is received thereby. However, in response to the three SLOCK pulses occurring between each occurrence of a TM4 pulse, auxiliary register 45 transmits data serially, AX1 to AX2, AX2 to AX3 to A1 via gates 460, 461 and 462, respectively. Thus, on the first pulse after a TM4 pulse, AX1 is empty, AX2 contains the data bit from AX1, AX3 contains the data bit from AX2, A1 contains the data bit from AX3 and A2 contains the data bit from A1. On the third pulse after a TM4 pulse, the time data has progressed so that AX1, AX2 and AX3 no longer contain time data and A1 contains the data bit first transmitted to AX1 from gate 427. On the next occurrence of a TM4 pulse, A1 simultaneously sends that data bit to A2 and receives a new data bit from gate 412 (i.e. A1 always contains time data), and AX1, AX2 and AX3 receive new data from gates 427, 422 and 417, respectively.

As mentioned above, inverting amplifier 443 determines the time data values received by AX1, AX2, AX3 and A1. Unless the output of gate 432 is a one, the output of inverter 443 is always a zero at a TM4 pulse. Thus, a zero will be received by AX1, AX2 and AX3 and by A1 unless the output of gate 432 is a one. As described above, the output of gate 442 is a one only when, in the 12 hour mode, the date word at the output of binary adder 41 has a value of three and the output of A28 has value of one at time TE6. If the output of gate 442 is a one at a TM4 pulse, a one is transmitted to A1 by the logical combination of data bits received by gates 463, 454, 455 and inverter 456.

For purposes of the preferred embodiment of this invention display of a six and a zero in the 10 and 1.0 seconds digits, respectively, would be improper in any mode. Similarly, in the 12 hour mode, display of a three or a two in the 1.0 or 10 hour digits or, in the 24 hour mode, display of a four or a three in the 1.0 or 10 hour digits respectively, would be improper. Using information received from added controller 43, auxiliary register 45 corrects the data it receives from binary adder 41 to prevent display of such data. It should be noted that auxiliary register 45 can perform its correction function at any arbitrary time data threshold. For example, if the time-keeping circuit of the present invention were to be used to record time in units of days, weeks, months and years, it would be improper for the 1.0 days digits to display an eight. Thus, for this case, auxiliary register 45 could be set to correct the time data representing the 1.0 day digit having a value of eight to a value of one.

To understand the correcting function of auxiliary register 45, assume that the data word at the output of binary adder 41 represents the 10 seconds digit and has a value of six. In binary format, 0, 1, 1 and 0 appear at the output of gates 427, 422, and 417 and 412, respectively. As the data is applied to gates 457, 458, 459, and 453, it is also detected by gate 437. Gate 464 also detects the one at the output of gate 417. The output of gate 464 is a one unless all inputs are one which only occurs in the 12 hour mode at TE7. Therefore, the output of gate 464 is a one, and, since the other input of gate 465 is a zero, the output thereof is a one.

Gate 437 applies a one to the input of gate 432 at a positive pulse of timing signal TL6 timed to coincide with processing of the data corresponding to this digit. Thus, by the above described analysis for the 10 seconds and 10 minutes digits, carry ff 430 is preset and the output of gate 433 is a one. Since the output of inverter 443 is a zero, AX1 receives a zero via gate 457, AX2 receives a zero via gate 458 and AX3 receives a zero via gate 459. A1 receives a zero by the logical combination of data bits received by gates 463, 454, 455, and inverter 456. Therefore auxiliary register 45 has corrected the data representing the value of the 10 seconds digit from a value of six to a value of zero.

Logic equations which mathematically define operation of the real-time register described above are presented in Table III.

Table III

Real Time Register Logic Equations

| Gate Name | Logic Equation |
|---|---|
| AA1 | = −(ACR.A32+−ACR.−A32) |
| AA2 | = −(AAA.A31+−AAA.−A31) |
| AA3 | = −(AAB.A30+−AAB.−A30) |
| AA4 | = −(AAC.A29+−AAC.−A29) |
| AAA | = −(−A32+−ACR) |
| AAB | = −(−A31+−AAA) |
| AAC | = −(−A30+−AAB) |
| DACR | = −(−(PL1.TE6).−(TE7+SA)) |
| SA | = −(TM4.TA) |
| TA | = $\overline{P1+P2+P3+TL6.AA2.AA3+AA2.AA4+PPG}$ |
| P1 | = −(H24+−(TE6.A28.AA1.AA2)) |
| P2 | = TE7.AA1.AA2 |
| P3 | = TE6.A27.AA3 |
| PPG | = AA2.TE7.−H24 |

Table III-continued

| | |
|---|---|
| PG | = −(AA4+−PPG) |
| JDATE | = −(PL1+−(P2+(AA4.PPG))) |
| ABI1 | = PG.SA+AA4.−SA |
| ABI2 | = AB1.SA+AA3.−SA |
| ABI | = AB2.SA+AA2.−SA |
| ABI4 | = AB3.SA+AA1.−SA |
| IA1 | = P1.TM4.F1T1+ABI4.F1T1+E32.F5T1 |

| Flip-Flop Name | Type | Clock | Input Equation |
|---|---|---|---|
| ACR | D | TM4 | DACR |
| AB1 | D | A CLOCK | ABI1 |
| AB2 | D | A CLOCK | ABI2 |
| AB3 | D | A CLOCK | ABI3 |
| AI | D | A CLOCK | IA1 |
| A[2:32] | D | A CLOCK | [An]← [An−1] |
| DATE | J/K | TM4 | J = JDATE K = TE7 |

Table IV-continued

| Flip-Flop Name | Type | Clock | Input Equation |
|---|---|---|---|
| BCR | D | TM4 | DBCR |
| BBB1 | D | BCLOCK | BBI1 |
| BBB2 | D | BCLOCK | BBI2 |
| BBB3 | D | BCLOCK | BBI3 |
| B1 | D | BCLOCK | IB1 |
| B[2:32] | D | BCLOCK | [Bn]←[Bn−1] |

Figure 6:
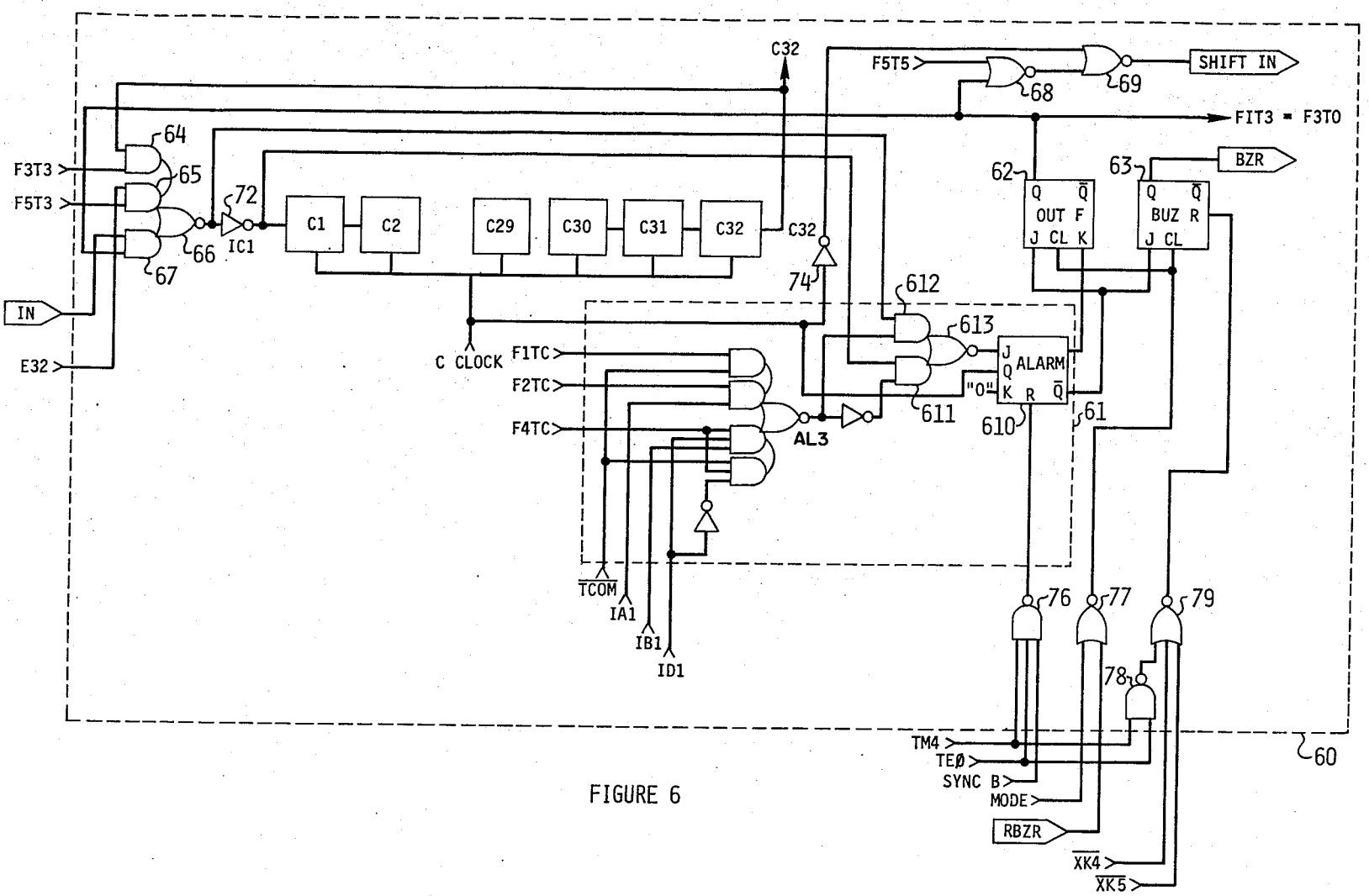
FIG. 6 is a logic diagram of the alarm register of the time-keeping circuit of FIG. 1.

Referring now to FIG. 6, alarm register 60 comprises delay elements C1 through C32, serial comparator 61, output ff 62, buzzer ff 63 and gates 64 through 69, inverters 72 and 74, and gates 76 through 79. Operation of this register is mathematically defined by the equations given in Table V.

Table V

Alarm Register Logic Equations

| | |
|---|---|
| IC1 | = $\overline{\text{F3T3.C32+F5T3.E32+FIT3.1N}}$ |
| ALS | = $\overline{\text{F1TC.IA1+F2TC.IB1+F4TC.TCOM.ID1+F4TC.TCOM.IA1}}$ |
| JALARM | = $\overline{\text{IC1.ALS}}$+IC1.ALS |
| KA-LARM | = "0" |
| RA-LARM | = $\overline{\text{TM4.TE0.SYNCB}}$ |
| CLBUZ | = TM4.TE0+XK4+XK5 |
| SHIFT IN | = CCLOCK.(FIT5+FIT3) |
| RBUZ | = $\overline{\text{MODE+RBZR}}$ |
| FLIP-FLOP | |
| ALARM | CLOCKED BY CCLOCK |
| BUZ | CLOCKED BY CLBUZ |
| OUT F | CLOCKED BY CLBUZ |
| C1 to C32 | CLOCKED BY CLOCK |

Figure 5:
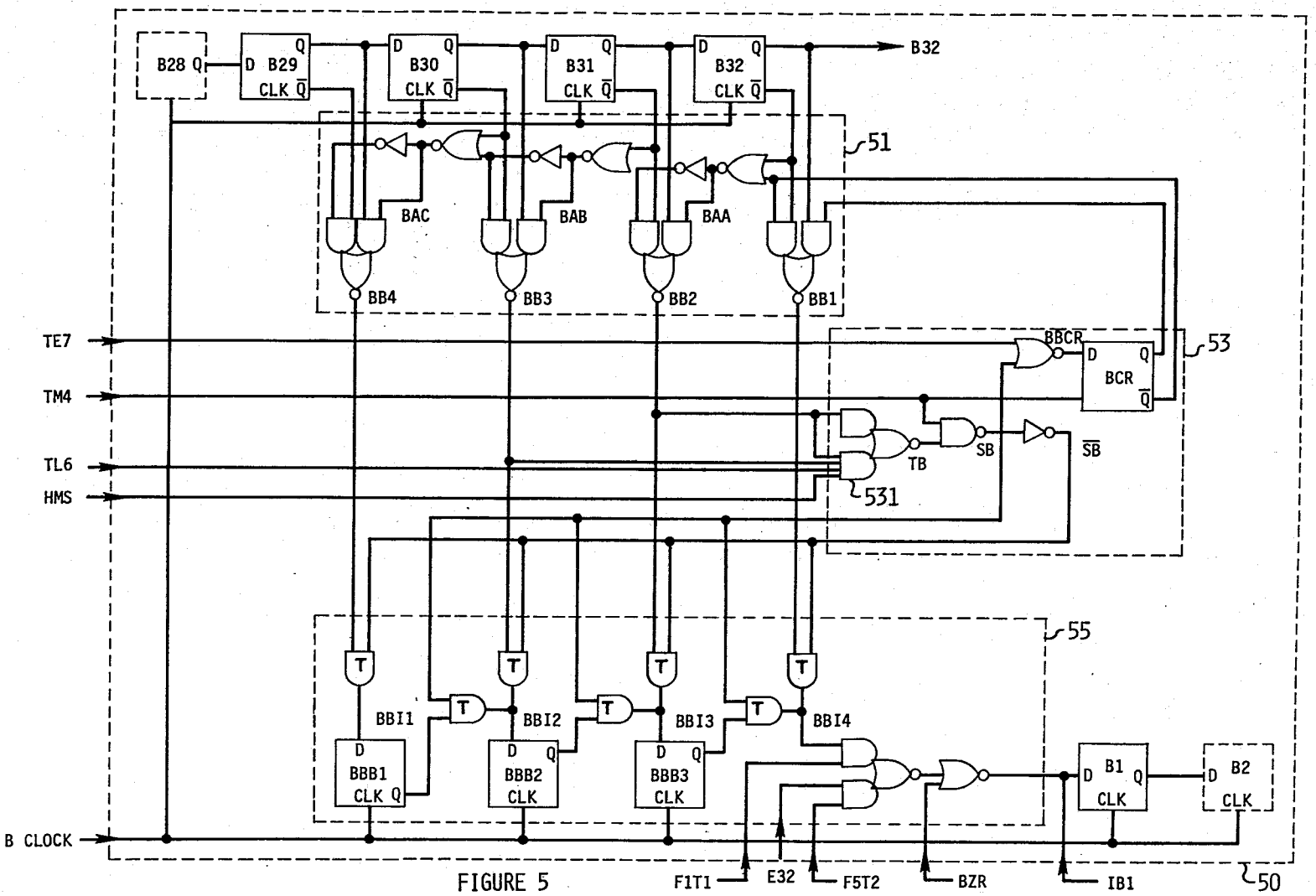
FIG. 5 is a logic diagram of the stopwatch register of the time-keeping circuit of FIG. 1.

Referring to FIG. 5, stopwatch register 50 is less complex than real-time register 40, comprising delay elements B1 through B32, binary adder 51, adder controller 53, and auxiliary register 55. Operation of this register is substantially the same as that described for real-time register 40 except that unless the HMS signal is applied to gate 531 to enable adder controller 53 to initiate auxiliary register 55 to correct the data, time data accumulated will be in units of seconds. With HMS signal applied (this signal is available from controller 20), stopwatch register 50 accumulates time in units of hours, minutes, seconds and hundredths-of-seconds (HMS mode) described earlier in this specification. The output of gate 531 is a one in the HMS mode when the output of binary adder 51 is at a binary value of six at a positive pulse of timing signal TL6. The logic equations given in Table IV mathematically define operation of the stopwatch register.

Table IV

Stopwatch Register Logic Equations

| Gate Name | Logic Equation |
|---|---|
| BB1 | = −(−BCR.B32+BCR.−B32) |
| BB2 | = −(BAA.B31+−BAA.−B31) |
| BB3 | = −(BAB.B30+−BAB.−B30) |
| BB4 | = −(BAC.B29+−BAC.−B29) |
| BAA | = −(−B32+BCR) |
| BAB | = −(−B31+−BAA) |
| BAC | = −(−B30+−BAB) |
| BBI1 | = −(BB4.−SB) |
| BBI2 | = BB3.−SB+−BB1.SB |
| BBI3 | = BB2.−SB+BBB2.SB |
| BBI4 | = BB1.−SB+BBB3.SB |
| DBCR | = −(TE7+SB) |
| SB | = −(TM4.TB) |
| TB | = −(BB2.BB4+BB2.BB3.TL6.HMS) |
| IB1 | = BBI4.F2T2+E32.F5T2 |

In the preferred embodiment preselected time data, representing the time at which an alarm is given, is entered via a calculator keyboard 10 as shown in FIG. 1. As the preselected time data IC1 circulates in the CSR delay elements, it is not incremented as in real-time register 40, but rather it is serially compared with data designated IA1, IB1, and for ID1 from the other registers via gates 611 and 612. When the data through either of these gates matches for all 32 bits, the output of gate 613 becomes a zero and ff 610 applies a zero to the K input of ff 62 and a one to the J input of ff's 62 and 63. When these ff's are next clocked, the Q output of both is a one. The Q output of ff 63 may be used then to actuate an audible, visible or other sensory alarm device. Since comparator 61 can process data from the real-time and data registers simultaneously, alarm register 60 can be set to give an alarm at a specified time on a particular date in the future.

Flip-flop 63 is also a source of low frequency periodic signals or asymetric timing signals. As time data increments in the stopwatch CSR, it is compared with the preselected data entered into the alarm register CSR by comparator 61. When the data matches, the signal produced at the Q output of ff 63 is effective for zeroing the stopwatch CSR when applied to the BZR input thereof. After zeroing, stopwatch register 50 continues to increment time data as before. Thus, the Q output of ff 63 becomes a source of an accurate, stable, low-frequency periodic signal having a period approximately equal to the real-time required for time data incrementing in the stopwatch register to equal the time data stored in the alarm register. Such a signal may be used for testing, calibration or control purposes.

An asymetric control or timing signal is generated at the Q output of ff 63 in a similar manner. Thirty-two bits of time data from an external register may be entered into the alarm register CSR via the IN input. When the time data incrementing in stopwatch register 50 equals the data in alarm register 60, the stopwatch register CSR is zeroed as described above and new data is entered into the alarm register CSR from another or the same external register. The width and repetition rate of the pulses comprising the signal at the Q output of ff 63 are separately controlled by appropriately varying the values of data successively entered into alarm register 60 from one or more external registers. As asymetric timing signal, corresponding to the values of that data, is then produced by ff 63.

Figure 7:
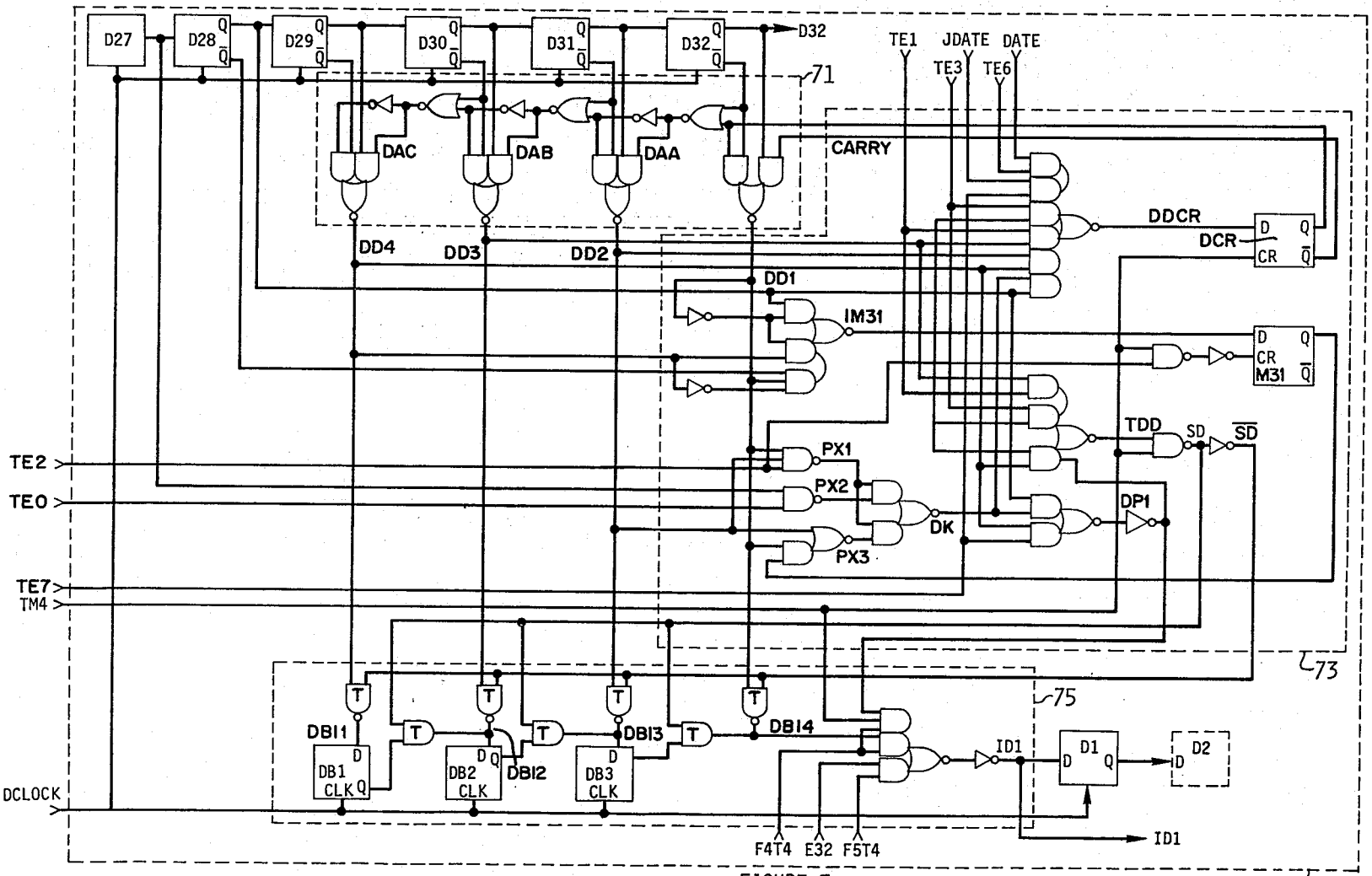
FIG. 7 is a logic diagram of the calendar date register of the time-keeping circuit of FIG. 1.

FIG. 7 shows date register 70, which is similar in complexity and operation to real-time register 40, comprising delay elements D1 through D32, binary adder 71, adder controller 73 and auxiliary register 75. Adder controller 73 receives date time data from the J Date and Date outputs of real-time register 40. That data is developed from the logical combination of data bits received by gates 46, 47, and 48, and ff 49. Refer to Table VI for the logic equations which mathematically define operation of date register 70.

Table VI

Date Register Logic Equations

| Gate Name | Logic Equation |
|---|---|
| DD1 | = −(−DCR.D32+DCR.−D32) |
| DD2 | = −(DAA.D31+−DAA.−D31) |
| DD3 | = −(DAB.D30+−DAB.−D30) |
| DD4 | = −(DAC.D29+−DAC.−D29) |
| DAA | = −(DCR+−D32) |
| DAB | = −(−DAA+−D31) |
| DAC | = −(−DAB+−D30) |
| DDCR | = −(DATE.TE6+JDATE.TE7+DD2.DD4+D28.DK+TE1.DD3+TE3.DD2) |
| TDD | = −(TE1.DD3+TE3.DD2+DD2.DD4+DP1) |
| DP1 | = D28.DK+TE7.DD4 |
| SD | = −(TDD.TM4) |
| DK | = −(PX1.PX2+PX1.PX3) |
| PX1 | = −(DD1.DD2.TEZ) |
| PX2 | = −(D27.TEO) |
| PX3 | = −(DD2+(DD1.M31) |
| CLM | = TM4.TE2 |
| IM31 | = −(D28.−DD1+−DD1.DD4+−D28.DD1.−DD4) |
| DBI1 | = −(DDR.−SD) |
| DBI2 | = SD.−DB1+−SD.DD3 |
| DBI3 | = SD.DB2+−SD.DD2 |
| DBI4 | = SD.DB3+−SD.DD1 |
| ID1 | = DP1.TM4.F4T4+DBI4.F4T4+E32.F5T4 |

| Flip-Flop Name | Type | Clock | Input Equation |
|---|---|---|---|
| DCR | D | TM4 | DDCR |
| M31 | D | CLM | IM31 |
| DB1 | D | DCLOCK | DBI1 |
| DB2 | D | DCLOCK | DBI2 |
| DB3 | D | DCLOCK | DBI3 |
| D1 | D | DCLOCK | ID1 |
| D[2:32] | D | DCLOCK | [Dn] ← [Dn−1] |

Figure 8:
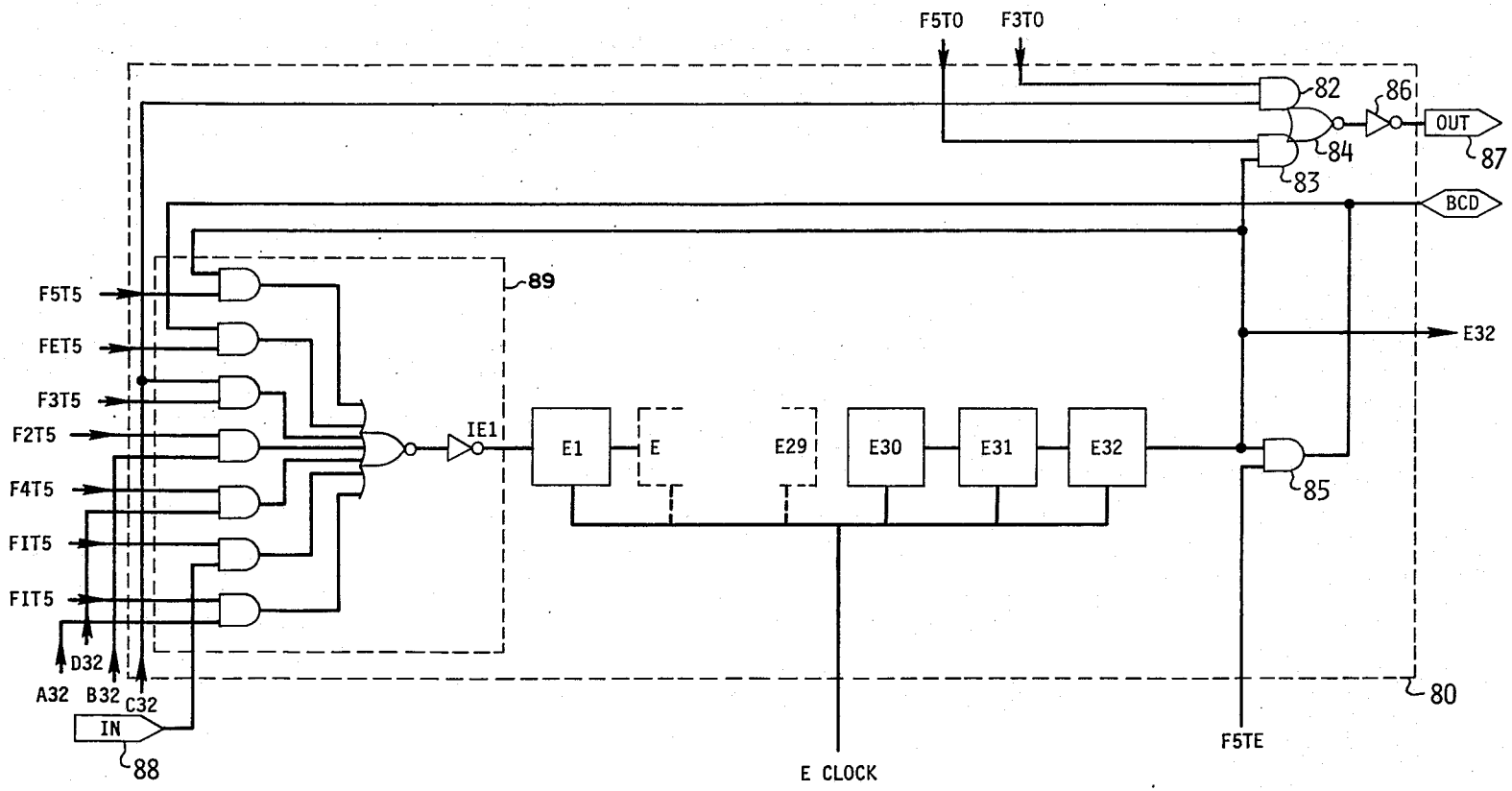
FIG. 8 is a logic diagram of the display register of the time-keeping circuit of FIG. 1.

Referring to FIG. 8, display register 80 comprises delay elements E1 through E32, input 89 and gates 82 through 85 and inverter 86. This register, operation of which is mathematically defined by the equations given in Table VII below, receives timing and command signals, and time data from the other registers via input 89 and provides the data, to display 81 via output 87. Furthermore, this register, after receiving the data through input 88 from keyboard 10, inputs original time-setting data and alarm-setting data to the appropriate registers via output E32.

Table VII

Display Register Logic Equations

| | |
|---|---|
| IE1 | $= \overline{\overline{F5T5.E32+FET5.BCD+F3T5.C32+F2T5.B32+F4T5.D32+FIT5.IN+\overline{FIT5.A32}}}$ |
| BCD | = BCD+F5TE.E32 |
| OUT | $= \overline{\overline{F3T0.C32+F5T0.E32}}$ |
| Flip-flop | |

E1 to E32 CLOCKED BY ECLOCK

Display 81 may be the same or similar to the LED display with auxiliary drivers described in U.S. Pat. No. 3,863,060 entitled "General Purpose Calculator with Capability for Performing Interdisciplinary Business Calculations," issued on Jan. 28, 1975 to France Rode et al. and assigned to the assignee hereof.

DETAILED LISTING OF ROUTINES AND SUBROUTINES OF INSTRUCTIONS

A listing of the routines and subroutines of instructions employed by the real-time, stopwatch and date registers of the time-keeping circuit of the present invention is given below. The listing also includes a simulation of time and date accumulations performed by the real-time and date registers. The real-time data is compressed to decades of seconds for a period of approximately one-hour 26 minutes as indicated in the third column of the data. The stopwatch time data shown in the third column is in units of hours, minutes, seconds and hundredths-of-seconds reading from left to right. The date time data is formatted as follows:

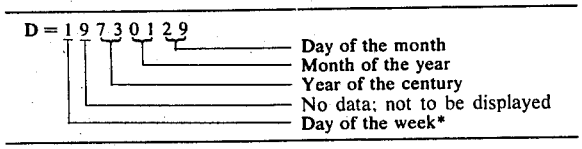

*The "first" day of the week is assignable by user.

```
DIGITAL SIMULATION SYSTEM
 1
 2    "TIMING AND A REGISTER SIMULATION"
 3  REGISTER
 4    DATE,ACR,AB[1:0],AC1:32],
 5    PL1,A24,READ,
 6    TJMM[6:1],SYNCA,QA1,
 7    XKA,XKB,XK[6:1],XI[6:1],CT[3:1].
 8  TERMINAL
 9    JDATE,KDATE,AA[1:4],ABI[1:4],SR1,AI,AAA,AAB,AAC,SA,TA,PPG,P1,P2,P3
10    SYNC ,SYNCB,DACR,XKK,
11    ADCL,ECLOCK,ACLOCK,BCLOCK,CCLOCK,DCLOCK,
12    PHASEONE,PHASETWO, CLX,JXK4,KXK4,
13    TD[1:9],TE0,TE2,TL6,TE7,TE6,TM4,TM1,TETTM4,TITE7,
14    JXK5,KXK5,JXK6,KXK6,3LOCK.
15  OPERATION
16    LOAD=[
17    A[13] ←1B1,A[18] ←1B1,A[16] ← 1B1,A[20] ← 1B1,A[10] ← 1B1,A[13] ← 1B1,
18    A[21] ←1B1,A[24] ←1B1,A[25] ← 1B1,A[28] ← 1B1,A[29] ← 1B1,A[32] ← 1B1
19    GO=[
20    PHASEONE=−(CT1*−CT2*CT3),
21    PHASETWO=−(CT1*CT2*CT3),
22    CT← (CT(+)1) TAIL 3,
23    TE0=−XT5*−XT4*−XT3,
24    TE2=−XT5*XT4*−XT3,
25    TL6=XT3*XT4+XT3*XT5,
26    TE7=XT5*XT4*XT3,
27    TE6=XT5*XT4*−XT3,
28    TM4=XT2*XT1,
29    TM1=−XT2*−XT1,
30    TETTM4=XT5*XT4*XT3*XT2*XT1,
31    TITE7=−(XT5*XT4*XT3*−XT2*XT1),
32    TD1=TE0,
33    TD2=TE2,
34    TD3=TL6,
35    TD4=TE7,
36    TD5=TE6,
37    TD6=TM4,
38    TD7=TM1,
39    TD8=TETTM4,
40    TD9=TITE7,
41    AAA=−( −A32+−ACR),
42    AAB=−(−A31+−AAA),
43    AAC=−(−A30+−AAB),
44    AA1=−(A32*HCR+−A32*−ACR),
45    AA2=−(A31*AAA+−A31*−AAA),
46    AA3=−(A30*AAB+−A30*−AAB),
47    AA4=−(A29*AAC+−A29*−AAC),
48    P1=−(H24+−(TE6*A28*AA1*AA2)),
49    P2=TE7*AA1*AA2,
50    P3=TE6*A27*AA3,
51    PPG=(AA2*TE7*−H24*TM4),
52    TA=−(P2+P3+TL6*AA2*AA3+AA2*AA4+PPG+P1),
53    SA=−(TM4*TA).
54    KDATE=TE7*TM4,
55    JDATE=−(PL1+−(P2+(AA4*PPG)))*TM4,
56    DATE ←↑JDATE CON KDATE↑1D0;1D1;−DATE;DATE.,
57    ABI1=4A4*−SA+−(AA4+−PPG)*SA,
58    AB12=AA3*−SA+AB1*SA,
59    ABI3=AA2*−SA+AB2*SA,
60    AB14=AA1*−SA+AB3*SA,
61    DACR=−(−(PL1*TE6)*−(TE7+SA)),
62    ↑TM4↑ACR← ACR.,
63    HI=TM4*P1+AB14,
64    AI=TM4*(P1+P3)+ABI4,
65    SR1=AI,
66    ↑CT1(=)1↑XKA ← −XKA.,
67    XKK=CT1*XKA,
68    ↑XKK↑XKB ←−XKB.,
69    ↑XKK*XKB↑XK1 ←−XK1.,
70    ↑XKK*XKB*XK1↑XK2 ←−XK2.,
71    ↑XKK*XKB*XK1*XK2↑XK3 ←−XK3.,
72    CLX=XKK*XKB*XK1*XK2*XK3,
73    JXK4=−(XK5*XK6)*CLX,
74    KXK4=CLX,
75    XK4 ←↑JXK4 CON KXK4 ↑1D0;1D1;−XK4;XK4.,
76    JXK5=XK4*CLX,
77    KXK5=−(−XK4*−XK6)*CLX,
78    XK5←↑ JXK5 CON KXK5↑1D0;1D1;−XK5;XK5.,
79    JXK6=CLX* XK4*XK5,
```

-continued

```
80    KXK6=CLX*−XK4*XK5,
81    XK6←↑JXK6 CON KXK6↑1DO;1D1;−XK6;XK6.,
82    SLOCK=1B1,
83    ↑SLOCK↑AB1 ←ABI1.,
84    ↑SLOCK↑AB2 ←ABI2.,
85    ↑SLOCK↑AB3← ABI3.,
86    SYNC=TIMM>=45*TIMM<55,
87    ↑−PHASETWO↑SYNCA ← SYNC.,
88    SYNCB= (XK2*XK3*XK4*XK6+XK5*XK6),
89    ADCL=−(−CT1+−(SYNCA*SYNCB+−SYNCA*−SYNCB)),
90    ↑ADCL*−PHASETWO↑TIMM←↑TIMM(=)55↑6D0;TIMM(+)1 TAIL 6..,
91    ACLOCK=SLOCK,
92    BLOCK=SLOCK,
93    CCLOCK=SLOCK,
94    DCLOCK=SLOCK,
95    ECLOCK=−(−SLOCK*−(READ*PHASEONE*−(CLX*XK5*XK6+XK3*−XK4*−XK6))),
96    ↑SLOCK↑XT1 ←−XT1.,
97    ↑SLOCK*XT1↑XT2 ←−XT2.,
98    ↑SLOCK*XT1*XT2↑XT3 ←−XT3.,
99    ↑SLOCK*XT1*XT2*XT3↑XT4 ←−XT4.,
100   ↑SLOCK*XT1*XT2*XT3*XT4↑XT5 ←−XT5.,
101   A ←AI CON A[1:31],
102   QA1=XT(=)2*A31*−A30*−A29*−A28,
103   ↑DATE↑OUTPUT(6,A,XT,DATE).,
104   ↑XT(=)3↑OUTPUT(6,A,DATE).
105   ].
106  CONTROl
107   XA1:GO,−>XA2/
108   XA2:↑QA1↑−>XA3;−>XA1./
109   XA3:LOAD,−>XA1/.$
END OF TRANSLATION, 0 ERRORS.

*TIME=6        STATE=XA1:  A=00000000
*TIME=7A       STATE=XA1:  A=00000000
*TIME=135      STATE=XA1:  A=00000999
*TIME=199      STATE=XA1:  A=00001000
*TIME=264      STATE=XA1:  A=00001999
*TIME=328      STATE=XA1:  A=00002000
*TIME=399      STATE=XA1:  A=00002999
*TIME=457      STATE=XA1:  A=00003000
*TIME=522      STATE=XA1:  A=00003999
*TIME=586      STATE=XA1:  A=00004000
*TIME=651      STATE=XA1:  A=00004999
*TIME=715      STATE=XA1:  A=00005000
*TIME=780      STATE=XA1:  A=00005999
*TIME=844      STATE=XA1:  A=00010000
*TIME=909      STATE=XA1:  A=00010999
*TIME=973      STATE=XA1:  A=00011000
*TIME=1038     STATE=XA1:  A=00011999
*TIME=1102     STATE=XA1:  A=00012000
*TIME=1167     STATE=XA1:  A=00012999
*TIME=1231     STATE=XA1:  A=00013000
*TIME=1296     STATE=XA1:  A=00013999
*TIME=1360     STATE=XA1:  A=00014000
*TIME=1425     STATE=XA1:  A=00014999
*TIME=1489     STATE=XA1:  A=00015000
*TIME=1554     STATE=XA1:  A=00015999
*TIME=1618     STATE=XA1:  A=00020000
*TIME=1683     STATE=XA1:  A=00020999
*TIME=1747     STATE=XA1:  A=00021000
*TIME=1812     STATE=XA1:  A=00021999
*TIME=1876     STATE=XA1:  A=00022000
*TIME=1941     STATE=XA1:  A=00022999
*TIME=2005     STATE=XA1:  A=00023000
*TIME=2070     STATE=XA1:  A=00023999
*TIME=2134     STATE=XA1:  A=00024000
*TIME=2199     STATE=XA1:  A=00024999
*TIME=2263     STATE=XA1:  A=00025000
*TIME=2328     STATE=XA1:  A=00025999
*TIME=2392     STATE=XA1:  A=00030000
*TIME=2457     STATE=XA1:  A=00030999
*TIME=2521     STATE=XA1:  A=00031000
*TIME=2586     STATE=XA1:  A=00031999
*TIME=2650     STATE=XA1:  A=00032000
*TIME=2715     STATE=XA1:  A=00032999
*TIME=2779     STATE=XA1:  A=00033000
*TIME=2844     STATE=XA1:  A=00033999
*TIME=2908     STATE=XA1:  A=00034000
*TIME=2973     STATE=XA1:  A=00034999
*TIME=3037     STATE=XA1:  A=00035000
*TIME=3102     STATE=XA1:  A=00035999
*TIME=3166     STATE=XA1:  A=00040000
*TIME=3231     STATE=XA1:  A=00040999
*TIME=3295     STATE=XA1:  A=00041000
*TIME=3360     STATE=XA1:  A=00041999
*TIME=3424     STATE=XA1:  A=00042000
*TIME=3489     STATE=XA1:  A=00042999
*TIME=3553     STATE=XA1:  A=00043000
*TIME=3618     STATE=XA1:  A=00043999
*TIME=3682     STATE=XA1:  A=00044000
*TIME=3747     STATE=XA1:  A=00044999
*TIME=3811     STATE=XA1:  A=00015000
*TIME=3876     STATE=XA1:  A=00045999
```

-continued

| | | |
|---|---|---|
| *TIME=3940 | STATE=XA1: | A=00050000 |
| *TIME=4005 | STATE=XA1: | A=00050999 |
| *TIME=4069 | STATE=XA1: | A=00051000 |
| *TIME=4134 | STATE=XA1: | A=00051999 |
| *TIME=4198 | STATE=XA1: | A=00052000 |
| *TIME=4263 | STATE=XA1: | A=00052999 |
| *TIME=4327 | STATE=XA1: | A=00053000 |
| *TIME=4392 | STATE=XA1: | A=00053999 |
| *TIME=4456 | STATE=XA1: | A=00054000 |
| *TIME=4521 | STATE=XA1: | A=00054999 |
| *TIME=4585 | STATE=XA1: | A=00055000 |
| *TIME=4650 | STATE=XA1: | A=00055999 |
| *TIME=4714 | STATE=XA1: | A=00060000 |
| *TIME=4779 | STATE=XA1: | A=00060999 |
| *TIME=4843 | STATE=XA1: | A=00061000 |
| *TIME=4908 | STATE=XA1: | A=00061999 |
| *TIME=4972 | STATE=XA1: | A=00062000 |
| *TIME=5037 | STATE=XA1: | A=00062999 |
| *TIME=5101 | STATE=XA1: | A=00063000 |
| *TIME=5166 | STATE=XA1: | A=00063999 |
| *TIME=5230 | STATE=XA1: | A=00064000 |
| *TIME=5295 | STATE=XA1: | A=00064999 |
| *TIME=5359 | STATE=XA1: | A=00065000 |
| *TIME=5424 | STATE=XA1: | A=00065999 |
| *TIME=5488 | STATE=XA1: | A=00070000 |
| *TIME=5553 | STATE=XA1: | A=00070999 |
| *TIME=5617 | STATE=XA1: | A=00071000 |
| *TIME=5682 | STATE=XA1: | A=00071999 |
| *TIME=5746 | STATE=XA1: | A=00072000 |
| *TIME=5811 | STATE=XA1: | A=00072999 |
| *TIME=5875 | STATE=XA1: | A=00073000 |
| *TIME=5940 | STATE=XA1: | A=00073999 |
| *TIME=6004 | STATE=XA1: | A=00074000 |
| *TIME=6069 | STATE=XA1: | A=00074999 |
| *TIME=6133 | STATE=XA1: | A=00075000 |
| *TIME=6198 | STATE=XA1: | A=00075999 |
| *TIME=6262 | STATE=XA1: | A=00080000 |
| *TIME=6327 | STATE=XA1: | A=00080999 |
| *TIME=6391 | STATE=XA1: | A=00081000 |
| *TIME=6456 | STATE=XA1: | A=00081999 |
| *TIME=6520 | STATE=XA1: | A=00082000 |
| *TIME=6585 | STATE=XA1: | A=00082999 |
| *TIME=6649 | STATE=XA1: | A=00083000 |
| *TIME=6714 | STATE=XA1: | A=00083999 |
| *TIME=6778 | STATE=XA1: | A=00084000 |
| *TIME=6843 | STATE=XA1: | A=00084999 |
| *TIME=6907 | STATE=XA1: | A=00085000 |
| *TIME=6972 | STATE=XA1: | A=00085999 |
| *TIME=7036 | STATE=XA1: | A=00090000 |
| *TIME=7101 | STATE=XA1: | A=00090999 |
| *TIME=7165 | STATE=XA1: | A=00091000 |
| *TIME=7230 | STATE=XA1: | A=00091999 |
| *TIME=7294 | STATE=XA1: | A=00092000 |
| *TIME=7059 | STATE=XA1: | A=00092999 |
| *TIME=7423 | STATE=XA1: | A=00093000 |
| *TIME=7430 | STATE=XA1: | A=00093999 |
| *TIME=7552 | STATE=XA1: | A=00094000 |
| *TIME=7617 | STATE=XA1: | A=00094999 |
| *TIME=7681 | STATE=XA1: | A=00095000 |
| *TIME=7746 | STATE=XA1: | A=00095999 |
| *TIME=7810 | STATE=XA1: | A=00100000 |
| *TIME=7875 | STATE=XA1: | A=00100999 |
| *TIME=7939 | STATE=XA1: | A=00101000 |
| *TIME=8004 | STATE=XA1: | A=00101999 |
| *TIME=8060 | STATE=XA1: | A=00102000 |
| *TIME=8133 | STATE=XA1: | A=00102999 |
| *TIME=8197 | STATE=XA1: | A=00103000 |
| *TIME=8262 | STATE=XA1: | A=00103999 |
| *TIME=8326 | STATE=XA1: | A=00104000 |
| *TIME=8391 | STATE=XA1: | A=00104999 |
| *TIME=8455 | STATE=XA1: | A=00105000 |
| *TIME=8520 | STATE=XA1: | A=00105999 |
| *TIME=8584 | STATE=XA1: | A=00110000 |
| *TIME=8649 | STATE=XA1: | A=00110999 |
| *TIME=8713 | STATE=XA1: | A=00111000 |
| *TIME=8778 | STATE=XA1: | A=00111999 |
| *TIME=8842 | STATE=XA1: | A=00112000 |
| *TIME=8907 | STATE=XA1: | A=00112999 |
| *TIME=8971 | STATE=XA1: | A=00113000 |
| *TIME=9036 | STATE=XA1: | A=00113999 |
| *TIME=9100 | STATE=XA1: | A=00114000 |
| *TIME=9165 | STATE=XA1: | A=00114999 |
| *TIME=9229 | STATE=XA1: | A=00115000 |
| *TIME=9294 | STATE=XA1: | A=00115999 |
| *TIME=9358 | STATE=XA1: | A=00120000 |
| *TIME=9423 | STATE=XA1: | A=00120999 |
| *TIME=9487 | STATE=XA1: | A=00121000 |
| *TIME=9552 | STATE=XA1: | A=00121999 |
| *TIME=9616 | STATE=XA1: | A=00122000 |
| *TIME=9681 | STATE=XA1: | A=00122999 |
| *TIME=9745 | STATE=XA1: | A=00123000 |
| *TIME=9810 | STATE=XA1: | A=00123999 |
| *TIME=9874 | STATE=XA1: | A=00124000 |

-continued

| | | |
|---|---|---|
| *TIME=9939 | STATE=XA1: | A=00124999 |
| *TIME=10003 | STATE=XA1: | A=00125000 |
| *TIME=10068 | STATE=XA1: | A=00125999 |
| *TIME=10132 | STATE=XA1: | A=00130000 |
| *TIME=10197 | STATE=XA1: | A=00130999 |
| *TIME=10261 | STATE=XA1: | A=00131000 |
| *TIME=10326 | STATE=XA1: | A=00131999 |
| *TIME=10390 | STATE=XA1: | A=00132000 |
| *TIME=10455 | STATE=XA1: | A=00132999 |
| *TIME=10519 | STATE=XA1: | A=00133000 |
| *TIME=10584 | STATE=XA1: | A=00133999 |
| *TIME=10648 | STATE=XA1: | A=00134000 |
| *TIME=10713 | STATE=XA1: | A=00134999 |
| *TIME=10777 | STATE=XA1: | A=00135000 |
| *TIME=10842 | STATE=XA1: | A=00135999 |
| *TIME=10906 | STATE=XA1: | A=00140000 |
| *TIME=10971 | STATE=XA1: | A=00140999 |
| *TIME=11035 | STATE=XA1: | A=00141000 |
| *TIME=11100 | STATE=XA1: | A=00141999 |
| *TIME=11164 | STATE=XA1: | A=00142000 |
| *TIME=11229 | STATE=XA1: | A=00142999 |
| *TIME=11293 | STATE=XA1: | A=00143000 |
| *TIME=11358 | STATE=XA1: | A=00143999 |
| *TIME=11422 | STATE=XA1: | A=00144000 |
| *TIME=11487 | STATE=XA1: | A=00144999 |
| *TIME=11551 | STATE=XA1: | A=00145000 |
| *TIME=11616 | STATE=XA1: | A=00145999 |
| *TIME=11680 | STATE=XA1: | A=00150000 |
| *TIME=11745 | STATE=XA1: | A=00150999 |
| *TIME=11809 | STATE=XA1: | A=00151000 |
| *TIME=11874 | STATE=XA1: | A=00151999 |
| *TIME=11938 | STATE=XA1: | A=00152000 |
| *TIME=12003 | STATE=XA1: | A=00152999 |
| *TIME=12067 | STATE=XA1: | A=00153000 |
| *TIME=12132 | STATE=XA1: | A=00153999 |
| *TIME=12196 | STATE=XA1: | A=00154000 |
| *TIME=12261 | STATE=XA1: | A=00154999 |
| *TIME=12325 | STATE=XA1: | A=00155000 |
| *TIME=12390 | STATE=XA1: | A=00155999 |
| *TIME=12454 | STATE=XA1: | A=00160000 |
| *TIME=12519 | STATE=XA1: | A=00160999 |
| *TIME=12583 | STATE=XA1: | A=00161000 |
| *TIME=12648 | STATE=XA1: | A=00161999 |
| *TIME=12712 | STATE=XA1: | A=00162000 |
| *TIME=12777 | STATE=XA1: | A=00162999 |
| *TIME=12841 | STATE=XA1: | A=00163000 |
| *TIME=12906 | STATE=XA1: | A=00163999 |
| *TIME=12970 | STATE=XA1: | A=00164000 |
| *TIME=13035 | STATE=XA1: | A=00164999 |
| *TIME=13099 | STATE=XA1: | A=00165000 |
| *TIME=13164 | STATE=XA1: | A=00165999 |
| *TIME=13228 | STATE=XA1: | A=00170000 |
| *TIME=13293 | STATE=XA1: | A=00170999 |
| *TIME=13357 | STATE=XA1: | A=00171000 |
| *TIME=13422 | STATE=XA1: | A=00171999 |
| *TIME=13486 | STATE=XA1: | A=00172000 |
| *TIME=13551 | STATE=XA1: | A=00172999 |
| *TIME=13615 | STATE=XA1: | A=00173000 |
| *TIME=13680 | STATE=XA1: | A=00173999 |
| *TIME=13744 | STATE=XA1: | A=00174000 |
| *TIME=13809 | STATE=XA1: | A=00174999 |
| *TIME=13873 | STATE=XA1: | A=00175000 |
| *TIME=13938 | STATE=XA1: | A=00175999 |
| *TIME=14002 | STATE=XA1: | A=00180000 |
| *TIME=14067 | STATE=XA1: | A=00180999 |
| *TIME=14131 | STATE=XA1: | A=00181000 |
| *TIME=14196 | STATE=XA1: | A=00181999 |
| *TIME=14260 | STATE=XA1: | A=00182000 |
| *TIME=14325 | STATE=XA1: | A=00182999 |
| *TIME=14389 | STATE=XA1: | A=00183000 |
| *TIME=14454 | STATE=XA1: | A=00183999 |
| *TIME=14518 | STATE=XA1: | A=00184000 |
| *TIME=14583 | STATE=XA1: | A=00184999 |
| *TIME=14647 | STATE=XA1: | A=00185000 |
| *TIME=14712 | STATE=XA1: | A=00185999 |
| *TIME=14776 | STATE=XA1: | A=00190000 |
| *TIME=14841 | STATE=XA1: | A=00190999 |
| *TIME=14905 | STATE=XA1: | A=00191000 |
| *TIME=14970 | STATE=XA1: | A=00191999 |
| *TIME=15034 | STATE=XA1: | A=00192000 |
| *TIME=15099 | STATE=XA1: | A=00192999 |
| *TIME=15163 | STATE=XA1: | A=00193000 |
| *TIME=15228 | STATE=XA1: | A=00193999 |
| *TIME=15292 | STATE=XA1: | A=00194000 |
| *TIME=15357 | STATE=XA1: | A=00194999 |
| *TIME=15421 | STATE=XA1: | A=00195000 |
| *TIME=15486 | STATE=XA1: | A=00195999 |
| *TIME=15550 | STATE=XA1: | A=00200000 |
| *TIME=15615 | STATE=XA1: | A=00200999 |
| *TIME=15679 | STATE=XA1: | A=00201000 |
| *TIME=15744 | STATE=XA1: | A=00201999 |
| *TIME=15808 | STATE=XA1: | A=00202000 |
| *TIME=15873 | STATE=XA1: | A=00202999 |

-continued

| | | |
|---|---|---|
| *TIME=15937 | STATE=XA1: | A=00203000 |
| *TIME=16002 | STATE=XA1: | A=00203999 |
| *TIME=16066 | STATE=XA1: | A=00204000 |
| *TIME=16131 | STATE=XA1: | A=00204999 |
| *TIME=16195 | STATE=XA1: | A=00205000 |
| *TIME=16260 | STATE=XA1: | A=00205999 |
| *TIME=16324 | STATE=XA1: | A=00210000 |
| *TIME=16389 | STATE=XA1: | A=00210999 |
| *TIME=16453 | STATE=XA1: | A=00211000 |
| *TIME=16518 | STATE=XA1: | A=00211999 |
| *TIME=16582 | STATE=XA1: | A=00212000 |
| *TIME=16647 | STATE=XA1: | A=00212999 |
| *TIME=16711 | STATE=XA1: | A=00213000 |
| *TIME=16776 | STATE=XA1: | A=00213999 |
| *TIME=16840 | STATE=XA1: | A=00214000 |
| *TIME=16905 | STATE=XA1: | A=00214999 |
| *TIME=16969 | STATE=XA1: | A=00215000 |
| *TIME=17034 | STATE=XA1: | A=00215999 |
| *TIME=17098 | STATE=XA1: | A=00220000 |
| *TIME=17163 | STATE=XA1: | A=00220999 |
| *TIME=17227 | STATE=XA1: | A=00221000 |
| *TIME=17292 | STATE=XA1: | A=00221999 |
| *TIME=17356 | STATE=XA1: | A=00222000 |
| *TIME=17421 | STATE=XA1: | A=00222999 |
| *TIME=17485 | STATE=XA1: | A=00223000 |
| *TIME=17550 | STATE=XA1: | A=00223999 |
| *TIME=17614 | STATE=XA1: | A=00224000 |
| *TIME=17679 | STATE=XA1: | A=00224999 |
| *TIME=17743 | STATE=XA1: | A=00225000 |
| *TIME=17808 | STATE=XA1: | A=00225999 |
| *TIME=17872 | STATE=XA1: | A=00230000 |
| *TIME=17937 | STATE=XA1: | A=00230999 |
| *TIME=18001 | STATE=XA1: | A=00231000 |
| *TIME=18066 | STATE=XA1: | A=00231999 |
| *TIME=18130 | STATE=XA1: | A=00232000 |
| *TIME=18195 | STATE=XA1: | A=00232999 |
| *TIME=18259 | STATE=XA1: | A=00233000 |
| *TIME=18324 | STATE=XA1: | A=00233999 |
| *TIME=18388 | STATE=XA1: | A=00234000 |
| *TIME=18453 | STATE=XA1: | A=00234999 |
| *TIME=18517 | STATE=XA1: | A=00235000 |
| *TIME=18582 | STATE=XA1: | A=00235999 |
| *TIME=18646 | STATE=XA1: | A=00240000 |
| *TIME=18711 | STATE=XA1: | A=00240999 |
| *TIME=18775 | STATE=XA1: | A=00241000 |
| *TIME=18840 | STATE=XA1: | A=00241999 |
| *TIME=18904 | STATE=XA1: | A=00242000 |
| *TIME=18969 | STATE=XA1: | A=00242999 |
| *TIME=19033 | STATE=XA1: | A=00243000 |
| *TIME=19098 | STATE=XA1: | A=00243999 |
| *TIME=19162 | STATE=XA1: | A=00244000 |
| *TIME=19227 | STATE=XA1: | A=00244999 |
| *TIME=19291 | STATE=XA1: | A=00245000 |
| *TIME=19356 | STATE=XA1: | A=00245999 |
| *TIME=19420 | STATE=XA1: | A=00250000 |
| *TIME=19485 | STATE=XA1: | A=00250999 |
| *TIME=19549 | STATE=XA1: | A=00251000 |
| *TIME=19614 | STATE=XA1: | A=00251999 |
| *TIME=19678 | STATE=XA1: | A=00252000 |
| *TIME=19743 | STATE=XA1: | A=00252999 |
| *TIME=19807 | STATE=XA1: | A=00253000 |
| *TIME=19872 | STATE=XA1: | A=00253999 |
| *TIME=19936 | STATE=XA1: | A=00254000 |
| *TIME=20001 | STATE=XA1: | A=00254999 |
| *TIME=20065 | STATE=XA1: | A=00255000 |
| *TIME=20130 | STATE=XA1: | A=00255999 |
| *TIME=20194 | STATE=XA1: | A=00260000 |
| *TIME=20259 | STATE=XA1: | A=00260999 |
| *TIME=20323 | STATE=XA1: | A=00261000 |
| *TIME=20388 | STATE=XA1: | A=00261999 |
| *TIME=20452 | STATE=XA1: | A=00262000 |
| *TIME=20517 | STATE=XA1: | A=00262999 |
| *TIME=20581 | STATE=XA1: | A=00263000 |
| *TIME=20646 | STATE=XA1: | A=00263999 |
| *TIME=20710 | STATE=XA1: | A=00264000 |
| *TIME=20775 | STATE=XA1: | A=00264999 |
| *TIME=20839 | STATE=XA1: | A=00265000 |
| *TIME=20904 | STATE=XA1: | A=00265999 |
| *TIME=20968 | STATE=XA1: | A=00270000 |
| *TIME=21033 | STATE=XA1: | A=00270999 |
| *TIME=21097 | STATE=XA1: | A=00271000 |
| *TIME=21162 | STATE=XA1: | A=00271999 |
| *TIME=21226 | STATE=XA1: | A=00272000 |
| *TIME=21291 | STATE=XA1: | A=00272999 |
| *TIME=21355 | STATE=XA1: | A=00273000 |
| *TIME=21420 | STATE=XA1: | A=00273999 |
| *TIME=21484 | STATE=XA1: | A=00274000 |
| *TIME=21549 | STATE=XA1: | A=00274999 |
| *TIME=21613 | STATE=XA1: | A=00275000 |
| *TIME=21678 | STATE=XA1: | A=00275999 |
| *TIME=21742 | STATE=XA1: | A=00280000 |
| *TIME=21807 | STATE=XA1: | A=00280999 |
| *TIME=21871 | STATE=XA1: | A=00281000 |

-continued

| | | |
|---|---|---|
| *TIME=21936 | STATE=XA1: | A=00281999 |
| *TIME=22000 | STATE=XA1: | A=00282000 |
| *TIME=22065 | STATE=XA1: | A=00282999 |
| *TIME=22129 | STATE=XA1: | A=00283000 |
| *TIME=22194 | STATE=XA1: | A=00283999 |
| *TIME=22258 | STATE=XA1: | A=00284000 |
| *TIME=22323 | STATE=XA1: | A=00284999 |
| *TIME=22387 | STATE=XA1: | A=00285000 |
| *TIME=22452 | STATE=XA1: | A=00285999 |
| *TIME=22516 | STATE=XA1: | A=00290000 |
| *TIME=22581 | STATE=XA1: | A=00290999 |
| *TIME=22645 | STATE=XA1: | A=00291000 |
| *TIME=22710 | STATE=XA1: | A=00291999 |
| *TIME=22774 | STATE=XA1: | A=00292000 |
| *TIME=22839 | STATE=XA1: | A=00292999 |
| *TIME=22903 | STATE=XA1: | A=00293000 |
| *TIME=22968 | STATE=XA1: | A=00293999 |
| *TIME=23032 | STATE=XA1: | A=00294000 |
| *TIME=23097 | STATE=XA1: | A=00294999 |
| *TIME=23161 | STATE=XA1: | A=00295000 |
| *TIME=23226 | STATE=XA1: | A=00295999 |
| *TIME=23290 | STATE=XA1: | A=00300000 |
| *TIME=23355 | STATE=XA1: | A=00300999 |
| *TIME=23419 | STATE=XA1: | A=00301000 |
| *TIME=23484 | STATE=XA1: | A=00301999 |
| *TIME=23548 | STATE=XA1: | A=00302000 |
| *TIME=23613 | STATE=XA1: | A=00302999 |
| *TIME=23677 | STATE=XA1: | A=00303000 |
| *TIME=23742 | STATE=XA1: | A=00303999 |
| *TIME=23806 | STATE=XA1: | A=00304000 |
| *TIME=23871 | STATE=XA1: | A=00304999 |
| *TIME=23935 | STATE=XA1: | A=00305000 |
| *TIME=24000 | STATE=XA1: | A=00305999 |
| *TIME=24064 | STATE=XA1: | A=00310000 |
| *TIME=24129 | STATE=XA1: | A=00310999 |
| *TIME=24193 | STATE=XA1: | A=00311000 |
| *TIME=24258 | STATE=XA1: | A=00311999 |
| *TIME=24322 | STATE=XA1: | A=00312000 |
| *TIME=24387 | STATE=XA1: | A=00312999 |
| *TIME=24451 | STATE=XA1: | A=00313000 |
| *TIME=24516 | STATE=XA1: | A=00313999 |
| *TIME=24580 | STATE=XA1: | A=00314000 |
| *TIME=24645 | STATE=XA1: | A=00314999 |
| *TIME=24709 | STATE=XA1: | A=00315000 |
| *TIME=24774 | STATE=XA1: | A=00315999 |
| *TIME=24838 | STATE=XA1: | A=00320000 |
| *TIME=24903 | STATE=XA1: | A=00320999 |
| *TIME=24967 | STATE=XA1: | A=00321000 |
| *TIME=25032 | STATE=XA1: | A=00321999 |
| *TIME=25096 | STATE=XA1: | A=00322000 |
| *TIME=25161 | STATE=XA1: | A=00322999 |
| *TIME=25225 | STATE=XA1: | A=00323000 |
| *TIME=25290 | STATE=XA1: | A=00323999 |
| *TIME=25354 | STATE=XA1: | A=00324000 |
| *TIME=25419 | STATE=XA1: | A=00324999 |
| *TIME=25483 | STATE=XA1: | A=00325000 |
| *TIME=25548 | STATE=XA1: | A=00325999 |
| *TIME=25612 | STATE=XA1: | A=00330000 |
| *TIME=25677 | STATE=XA1: | A=00330999 |
| *TIME=25741 | STATE=XA1: | A=00331000 |
| *TIME=25806 | STATE=XA1: | A=00331999 |
| *TIME=25870 | STATE=XA1: | A=00332000 |
| *TIME=25935 | STATE=XA1: | A=00332999 |
| *TIME=25999 | STATE=XA1: | A=00333000 |
| *TIME=26064 | STATE=XA1: | A=00333999 |
| *TIME=26128 | STATE=XA1: | A=00334000 |
| *TIME=26193 | STATE=XA1: | A=00334999 |
| *TIME=26257 | STATE=XA1: | A=00335000 |
| *TIME=26322 | STATE=XA1: | A=00335999 |
| *TIME=26386 | STATE=XA1: | A=00340000 |
| *TIME=26451 | STATE=XA1: | A=00340999 |
| *TIME=26515 | STATE=XA1: | A=00341000 |
| *TIME=26580 | STATE=XA1: | A=00341999 |
| *TIME=26644 | STATE=XA1: | A=00342000 |
| *TIME=26709 | STATE=XA1: | A=00342999 |
| *TIME=26773 | STATE=XA1: | A=00343000 |
| *TIME=26838 | STATE=XA1: | A=00343999 |
| *TIME=26902 | STATE=XA1: | A=00344000 |
| *TIME=26967 | STATE=XA1: | A=00344999 |
| *TIME=27031 | STATE=XA1: | A=00345000 |
| *TIME=27096 | STATE=XA1: | A=00345999 |
| *TIME=27160 | STATE=XA1: | A=00350000 |
| *TIME=27225 | STATE=XA1: | A=00350999 |
| *TIME=27289 | STATE=XA1: | A=00351000 |
| *TIME=27354 | STATE=XA1: | A=00351999 |
| *TIME=27418 | STATE=XA1: | A=00352000 |
| *TIME=27483 | STATE=XA1: | A=00352999 |
| *TIME=27547 | STATE=XA1: | A=00353000 |
| *TIME=27612 | STATE=XA1: | A=00353999 |
| *TIME=27676 | STATE=XA1: | A=00354000 |
| *TIME=27741 | STATE=XA1: | A=00354999 |
| *TIME=27805 | STATE=XA1: | A=00355000 |
| *TIME=27870 | STATE=XA1: | A=00355999 |

-continued

| | | |
|---|---|---|
| *TIME=27934 | STATE=XA1: | A=00360000 |
| *TIME=27999 | STATE=XA1: | A=00360999 |
| *TIME=28063 | STATE=XA1: | A=00361000 |
| *TIME=28128 | STATE=XA1: | A=00361999 |
| *TIME=28192 | STATE=XA1: | A=00362000 |
| *TIME=28257 | STATE=XA1: | A=00362999 |
| *TIME=28321 | STATE=XA1: | A=00363000 |
| *TIME=28386 | STATE=XA1: | A=00363999 |
| *TIME=28450 | STATE=XA1: | A=00364000 |
| *TIME=28515 | STATE=XA1: | A=00364999 |
| *TIME=28579 | STATE=XA1: | A=00365000 |
| *TIME=28644 | STATE=XA1: | A=00365999 |
| *TIME=28708 | STATE=XA1: | A=00370000 |
| *TIME=28773 | STATE=XA1: | A=00370999 |
| *TIME=28837 | STATE=XA1: | A=00371000 |
| *TIME=28902 | STATE=XA1: | A=00371999 |
| *TIME=28966 | STATE=XA1: | A=00372000 |
| *TIME=29031 | STATE=XA1: | A=00372999 |
| *TIME=29095 | STATE=XA1: | A=00373000 |
| *TIME=29160 | STATE=XA1: | A=00373999 |
| *TIME=29224 | STATE=XA1: | A=00374000 |
| *TIME=29289 | STATE=XA1: | A=00374999 |
| *TIME=29353 | STATE=XA1: | A=00375000 |
| *TIME=29418 | STATE=XA1: | A=00375999 |
| *TIME=29482 | STATE=XA1: | A=00380000 |
| *TIME=29547 | STATE=XA1: | A=00380999 |
| *TIME=29611 | STATE=XA1: | A=00381000 |
| *TIME=29676 | STATE=XA1: | A=00381999 |
| *TIME=29740 | STATE=XA1: | A=00382000 |
| *TIME=29805 | STATE=XA1: | A=00382999 |
| *TIME=29869 | STATE=XA1: | A=00383000 |
| *TIME=29934 | STATE=XA1: | A=00383999 |
| *TIME=29998 | STATE=XA1: | A=00384000 |
| *TIME=30063 | STATE=XA1: | A=00384999 |
| *TIME=30127 | STATE=XA1: | A=00385000 |
| *TIME=30192 | STATE=XA1: | A=00385999 |
| *TIME=30256 | STATE=XA1: | A=00390000 |
| *TIME=30321 | STATE=XA1: | A=00390999 |
| *TIME=30385 | STATE=XA1: | A=00391000 |
| *TIME=30450 | STATE=XA1: | A=00391999 |
| *TIME=30514 | STATE=XA1: | A=00392000 |
| *TIME=30579 | STATE=XA1: | A=00392999 |
| *TIME=30643 | STATE=XA1: | A=00393000 |
| *TIME=30708 | STATE=XA1: | A=00393999 |
| *TIME=30772 | STATE=XA1: | A=00394000 |
| *TIME=30837 | STATE=XA1: | A=00394999 |
| *TIME=30901 | STATE=XA1: | A=00395000 |
| *TIME=30966 | STATE=XA1: | A=00395999 |
| *TIME=31030 | STATE=XA1: | A=00400000 |
| *TIME=31095 | STATE=XA1: | A=00400999 |
| *TIME=31159 | STATE=XA1: | A=00401000 |
| *TIME=31224 | STATE=XA1: | A=00401999 |
| *TIME=31288 | STATE=XA1: | A=00402000 |
| *TIME=31353 | STATE=XA1: | A=00402999 |
| *TIME=31417 | STATE=XA1: | A=00403000 |
| *TIME=31482 | STATE=XA1: | A=00403999 |
| *TIME=31546 | STATE=XA1: | A=00404000 |
| *TIME=31611 | STATE=XA1: | A=00404999 |
| *TIME=31675 | STATE=XA1: | A=00405000 |
| *TIME=31740 | STATE=XA1: | A=00405999 |
| *TIME=31804 | STATE=XA1: | A=00410000 |
| *TIME=31869 | STATE=XA1: | A=00410999 |
| *TIME=31933 | STATE=XA1: | A=00411000 |
| *TIME=31998 | STATE=XA1: | A=00411999 |
| *TIME=32062 | STATE=XA1: | A=00412000 |
| *TIME=32127 | STATE=XA1: | A=00412999 |
| *TIME=32191 | STATE=XA1: | A=00413000 |
| *TIME=32256 | STATE=XA1: | A=00413999 |
| *TIME=32320 | STATE=XA1: | A=00414000 |
| *TIME=32385 | STATE=XA1: | A=00414999 |
| *TIME=32449 | STATE=XA1: | A=00415000 |
| *TIME=32514 | STATE=XA1: | A=00415999 |
| *TIME=32578 | STATE=XA1: | A=00420000 |
| *TIME=32643 | STATE=XA1: | A=00420999 |
| *TIME=32707 | STATE=XA1: | A=00421000 |
| *TIME=4 | STATE=XA1: | A=00421999 |
| *TIME=68 | STATE=XA1: | A=00422000 |
| *TIME=133 | STATE=XA1: | A=00422999 |
| *TIME=197 | STATE=XA1: | A=00423000 |
| *TIME=262 | STATE=XA1: | A=00423999 |
| *TIME=326 | STATE=XA1: | A=00424000 |
| *TIME=391 | STATE=XA1: | A=00424999 |
| *TIME=455 | STATE=XA1: | A=00425000 |
| *TIME=520 | STATE=XA1: | A=00425999 |
| *TIME=584 | STATE=XA1: | A=00430000 |
| *TIME=649 | STATE=XA1: | A=00430999 |
| *TIME=713 | STATE=XA1: | A=00431000 |
| *TIME=778 | STATE=XA1: | A=00431999 |
| *TIME=842 | STATE=XA1: | A=00432000 |
| *TIME=907 | STATE=XA1: | A=00432999 |
| *TIME=971 | STATE=XA1: | A=00433000 |
| *TIME=1036 | STATE=XA1: | A=00433999 |
| *TIME=1100 | STATE=XA1: | A=00434000 |

-continued

| | | |
|---|---|---|
| *TIME=1165 | STATE=XA1: | A=00434999 |
| *TIME=1229 | STATE=XA1: | A=00435000 |
| *TIME=1294 | STATE=XA1: | A=00435999 |
| *TIME=1358 | STATE=XA1: | A=00440000 |
| *TIME=1423 | STATE=XA1: | A=00440999 |
| *TIME=1487 | STATE=XA1: | A=00441000 |
| *TIME=1552 | STATE=XA1: | A=00441999 |
| *TIME=1616 | STATE=XA1: | A=00442000 |
| *TIME=1681 | STATE=XA1: | A=00442999 |
| *TIME=1745 | STATE=XA1: | A=00443000 |
| *TIME=1810 | STATE=XA1: | A=00443999 |
| *TIME=1874 | STATE=XA1: | A=00444000 |
| *TIME=1939 | STATE=XA1: | A=00444999 |
| *TIME=2003 | STATE=XA1: | A=00445000 |
| *TIME=2068 | STATE=XA1: | A=00445999 |
| *TIME=2132 | STATE=XA1: | A=00450000 |
| *TIME=2197 | STATE=XA1: | A=00450999 |
| *TIME=2261 | STATE=XA1: | A=00451000 |
| *TIME=2326 | STATE=XA1: | A=00451999 |
| *TIME=2390 | STATE=XA1: | A=00452000 |
| *TIME=2455 | STATE=XA1: | A=00452999 |
| *TIME=2519 | STATE=XA1: | A=00453000 |
| *TIME=2584 | STATE=XA1: | A=00453999 |
| *TIME=2648 | STATE=XA1: | A=00454000 |
| *TIME=2713 | STATE=XA1: | A=00454999 |
| *TIME=2777 | STATE=XA1: | A=00455000 |
| *TIME=2842 | STATE=XA1: | A=00455999 |
| *TIME=2906 | STATE=XA1: | A=00460000 |
| *TIME=2971 | STATE=XA1: | A=00460999 |
| *TIME=3035 | STATE=XA1: | A=00461000 |
| *TIME=3100 | STATE=XA1: | A=00461999 |
| *TIME=3164 | STATE=XA1: | A=00462000 |
| *TIME=3229 | STATE=XA1: | A=00462999 |
| *TIME=3293 | STATE=XA1: | A=00463000 |
| *TIME=3358 | STATE=XA1: | A=00463999 |
| *TIME=3422 | STATE=XA1: | A=00464000 |
| *TIME=3487 | STATE=XA1: | A=00464999 |
| *TIME=3551 | STATE=XA1: | A=00465000 |
| *TIME=3616 | STATE=XA1: | A=00465999 |
| *TIME=3680 | STATE=XA1: | A=00470000 |
| *TIME=3745 | STATE=XA1: | A=00470999 |
| *TIME=3809 | STATE=XA1: | A=00471000 |
| *TIME=3874 | STATE=XA1: | A=00471999 |
| *TIME=3938 | STATE=XA1: | A=00472000 |
| *TIME=4003 | STATE=XA1: | A=00472999 |
| *TIME=4067 | STATE=XA1: | A=00473000 |
| *TIME=4132 | STATE=XA1: | A=00473999 |
| *TIME=4196 | STATE=XA1: | A=00474000 |
| *TIME=4261 | STATE=XA1: | A=00474999 |
| *TIME=4325 | STATE=XA1: | A=00475000 |
| *TIME=4390 | STATE=XA1: | A=00475999 |
| *TIME=4454 | STATE=XA1: | A=00480000 |
| *TIME=4519 | STATE=XA1: | A=00480999 |
| *TIME=4583 | STATE=XA1: | A=00481000 |
| *TIME=4648 | STATE=XA1: | A=00481999 |
| *TIME=4712 | STATE=XA1: | A=00482000 |
| *TIME=4777 | STATE=XA1: | A=00482999 |
| *TIME=4841 | STATE=XA1: | A=00483000 |
| *TIME=4906 | STATE=XA1: | A=00483999 |
| *TIME=4970 | STATE=XA1: | A=00484000 |
| *TIME=5035 | STATE=XA1: | A=00484999 |
| *TIME=5099 | STATE=XA1: | A=00485000 |
| *TIME=5164 | STATE=XA1: | A=00485999 |
| *TIME=5228 | STATE=XA1: | A=00490000 |
| *TIME=5293 | STATE=XA1: | A=00490999 |
| *TIME=5357 | STATE=XA1: | A=00491000 |
| *TIME=5422 | STATE=XA1: | A=00491999 |
| *TIME=5486 | STATE=XA1: | A=00492000 |
| *TIME=5551 | STATE=XA1: | A=00492999 |
| *TIME=5615 | STATE=XA1: | A=00493000 |
| *TIME=5680 | STATE=XA1: | A=00493999 |
| *TIME=5744 | STATE=XA1: | A=00494000 |
| *TIME=5809 | STATE=XA1: | A=00494999 |
| *TIME=5873 | STATE=XA1: | A=00495000 |
| *TIME=5938 | STATE=XA1: | A=00495999 |
| *TIME=6002 | STATE=XA1: | A=00500000 |
| *TIME=6067 | STATE=XA1: | A=00500999 |
| *TIME=6131 | STATE=XA1: | A=00501000 |
| *TIME=6196 | STATE=XA1: | A=00501999 |
| *TIME=6260 | STATE=XA1: | A=00502000 |
| *TIME=6325 | STATE=XA1: | A=00502999 |
| *TIME=6389 | STATE=XA1: | A=00503000 |
| *TIME=6454 | STATE=XA1: | A=00503999 |
| *TIME=6518 | STATE=XA1: | A=00504000 |
| *TIME=6583 | STATE=XA1: | A=00504999 |
| *TIME=6647 | STATE=XA1: | A=00505000 |
| *TIME=6712 | STATE=XA1: | A=00505999 |
| *TIME=6776 | STATE=XA1: | A=00510000 |
| *TIME=6841 | STATE=XA1: | A=00510999 |
| *TIME=6905 | STATE=XA1: | A=00511000 |
| *TIME=6970 | STATE=XA1: | A=00511999 |
| *TIME=7034 | STATE=XA1: | A=00512000 |
| *TIME=7099 | STATE=XA1: | A=00512999 |

-continued

| | | |
|---|---|---|
| *TIME=7163 | STATE=XA1: | A=00513000 |
| *TIME=7228 | STATE=XA1: | A=00513999 |
| *TIME=7292 | STATE=XA1: | A=00514000 |
| *TIME=7357 | STATE=XA1: | A=00514999 |
| *TIME=7421 | STATE=XA1: | A=00515000 |
| *TIME=7486 | STATE=XA1: | A=00515999 |
| *TIME=7550 | STATE=XA1: | A=00520000 |
| *TIME=7615 | STATE=XA1: | A=00520999 |
| *TIME=7679 | STATE=XA1: | A=00521000 |
| *TIME=7744 | STATE=XA1: | A=00521999 |
| *TIME=7808 | STATE=XA1: | A=00522000 |
| *TIME=7873 | STATE=XA1: | A=00522999 |
| *TIME=7937 | STATE=XA1: | A=00523000 |
| *TIME=8002 | STATE=XA1: | A=00523999 |
| *TIME=8066 | STATE=XA1: | A=00524000 |
| *TIME=8131 | STATE=XA1: | A=00524999 |
| *TIME=8195 | STATE=XA1: | A=00525000 |
| *TIME=8260 | STATE=XA1: | A=00525999 |
| *TIME=8324 | STATE=XA1: | A=00530000 |
| *TIME=8389 | STATE=XA1: | A=00530999 |
| *TIME=8453 | STATE=XA1: | A=00531000 |
| *TIME=8518 | STATE=XA1: | A=00531999 |
| *TIME=8582 | STATE=XA1: | A=00532000 |
| *TIME=8647 | STATE=XA1: | A=00532999 |
| *TIME=8711 | STATE=XA1: | A=00533000 |
| *TIME=8776 | STATE=XA1: | A=00533999 |
| *TIME=8840 | STATE=XA1: | A=00534000 |
| *TIME=8905 | STATE=XA1: | A=00534999 |
| *TIME=8969 | STATE=XA1: | A=00535000 |
| *TIME=9034 | STATE=XA1: | A=00535999 |
| *TIME=9098 | STATE=XA1: | A=00540000 |
| *TIME=9163 | STATE=XA1: | A=00540999 |
| *TIME=9227 | STATE=XA1: | A=00541000 |
| *TIME=9292 | STATE=XA1: | A=00541999 |
| *TIME=9356 | STATE=XA1: | A=00542000 |
| *TIME=9421 | STATE=XA1: | A=00542999 |
| *TIME=9485 | STATE=XA1: | A=00543000 |
| *TIME=9550 | STATE=XA1: | A=00543999 |
| *TIME=9614 | STATE=XA1: | A=00544000 |
| *TIME=9679 | STATE=XA1: | A=00544999 |
| *TIME=9743 | STATE=XA1: | A=00545000 |
| *TIME=9808 | STATE=XA1: | A=00545999 |
| *TIME=9872 | STATE=XA1: | A=00550000 |
| *TIME=9937 | STATE=XA1: | A=00550999 |
| *TIME=10001 | STATE=XA1: | A=00551000 |
| *TIME=10066 | STATE=XA1: | A=00551999 |
| *TIME=10130 | STATE=XA1: | A=00552000 |
| *TIME=10195 | STATE=XA1: | A=00552999 |
| *TIME=10259 | STATE=XA1: | A=00553000 |
| *TIME=10324 | STATE=XA1: | A=00553999 |
| *TIME=10388 | STATE=XA1: | A=00554000 |
| *TIME=10453 | STATE=XA1: | A=00554999 |
| *TIME=10517 | STATE=XA1: | A=00555000 |
| *TIME=10582 | STATE=XA1: | A=00555999 |
| *TIME=10646 | STATE=XA1: | A=00560000 |
| *TIME=10711 | STATE=XA1: | A=00560999 |
| *TIME=10775 | STATE=XA1: | A=00561000 |
| *TIME=10840 | STATE=XA1: | A=00561999 |
| *TIME=10904 | STATE=XA1: | A=00562000 |
| *TIME=10969 | STATE=XA1: | A=00562999 |
| *TIME=11033 | STATE=XA1: | A=00563000 |
| *TIME=11098 | STATE=XA1: | A=00563999 |
| *TIME=11162 | STATE=XA1: | A=00564000 |
| *TIME=11227 | STATE=XA1: | A=00564999 |
| *TIME=11291 | STATE=XA1: | A=00565000 |
| *TIME=11356 | STATE=XA1: | A=00565999 |
| *TIME=11420 | STATE=XA1: | A=00570000 |
| *TIME=11485 | STATE=XA1: | A=00570999 |
| *TIME=11549 | STATE=XA1: | A=00571000 |
| *TIME=11614 | STATE=XA1: | A=00571999 |
| *TIME=11678 | STATE=XA1: | A=00572000 |
| *TIME=11743 | STATE=XA1: | A=00572999 |
| *TIME=11807 | STATE=XA1: | A=00573000 |
| *TIME=11872 | STATE=XA1: | A=00573999 |
| *TIME=11936 | STATE=XA1: | A=00574000 |
| *TIME=12001 | STATE=XA1: | A=00574999 |
| *TIME=12065 | STATE=XA1: | A=00575000 |
| *TIME=12130 | STATE=XA1: | A=00575999 |
| *TIME=12194 | STATE=XA1: | A=00580000 |
| *TIME=12259 | STATE=XA1: | A=00580999 |
| *TIME=12323 | STATE=XA1: | A=00581000 |
| *TIME=12388 | STATE=XA1: | A=00581999 |
| *TIME=12452 | STATE=XA1: | A=00582000 |
| *TIME=12517 | STATE=XA1: | A=00582999 |
| *TIME=12581 | STATE=XA1: | A=00583000 |
| *TIME=12646 | STATE=XA1: | A=00583999 |
| *TIME=12710 | STATE=XA1: | A=00584000 |
| *TIME=12775 | STATE=XA1: | A=00584999 |
| *TIME=12839 | STATE=XA1: | A=00585000 |
| *TIME=12904 | STATE=XA1: | A=00585999 |
| *TIME=12968 | STATE=XA1: | A=00590000 |
| *TIME=13033 | STATE=XA1: | A=00590999 |
| *TIME=13097 | STATE=XA1: | A=00591000 |

-continued

| | | |
|---|---|---|
| *TIME=13162 | STATE=XA1: | A=00591999 |
| *TIME=10226 | STATE=XA1: | A=00592000 |
| *TIME=13291 | STATE=XA1: | A=00592999 |
| *TIME=13355 | STATE=XA1: | A=00593000 |
| *TIME=13420 | STATE=XA1: | A=00593999 |
| *TIME=13484 | STATE=XA1: | A=00594000 |
| *TIME=13549 | STATE=XA1: | A=00594999 |
| *TIME=13613 | STATE=XA1: | A=00595000 |
| *TIME=13678 | STATE=XA1: | A=00595999 |
| *TIME=13742 | STATE=XA1: | A=01000000 |
| *TIME=13807 | STATE=XA1: | A=01000999 |
| *TIME=13871 | STATE=XA1: | A=01001000 |
| *TIME=13936 | STATE=XA1: | A=01001999 |
| *TIME=14000 | STATE=XA1: | A=01002000 |
| *TIME=14065 | STATE=XA1: | A=01002999 |
| *TIME=14129 | STATE=XA1: | A=01003000 |
| *TIME=14194 | STATE=XA1: | A=01003999 |
| *TIME=14258 | STATE=XA1: | A=01001000 |
| *TIME=14328 | STATE=XA1: | A=01004999 |
| *TIME=14387 | STATE=XA1: | A=01005000 |
| *TIME=14452 | STATE=XA1: | A=01005999 |
| *TIME=14516 | STATE=XA1: | A=01010000 |
| *TIME=14581 | STATE=XA1: | A=01010999 |
| *TIME=14645 | STATE=XA1: | A=01011000 |
| *TIME=14710 | STATE=XA1: | A=01011999 |
| *TIME=14774 | STATE=XA1: | A=01012000 |
| *TIME=14889 | STATE=XA1: | A=01012999 |
| *TIME=14903 | STATE=XA1: | A=01013000 |
| *TIME=14968 | STATE=XA1: | A=01013999 |
| *TIME=15032 | STATE=XA1: | A=01014000 |
| *TIME=15097 | STATE=XA1: | A=01014999 |
| *TIME=15161 | STATE=XA1: | A=01015000 |
| *TIME=15226 | STATE=XA1: | A=01015999 |
| *TIME=15290 | STATE=XA1: | A=01020000 |
| *TIME=15355 | STATE=XA1: | A=01020999 |
| *TIME=15419 | STATE=XA1: | A=01021000 |
| *TIME=15484 | STATE=XA1: | A=01021999 |
| *TIME=15548 | STATE=XA1: | A=01022000 |
| *TIME=15613 | STATE=XA1: | A=01022999 |
| *TIME=15677 | STATE=XA1: | A=01023000 |
| *TIME=15742 | STATE=XA1: | A=01023999 |
| *TIME=15806 | STATE=XA1: | A=01024000 |
| *TIME=15871 | STATE=XA1: | A=01024999 |
| *TIME=15935 | STATE=XA1: | A=01025000 |
| *TIME=16000 | STATE=XA1: | A=01025999 |
| *TIME=16064 | STATE=XA1: | A=01030000 |
| *TIME=16129 | STATE=XA1: | A=01030999 |
| *TIME=16193 | STATE=XA1: | A=01031000 |
| *TIME=16258 | STATE=XA1: | A=01031999 |
| *TIME=16322 | STATE=XA1: | A=01032000 |
| *TIME=16387 | STATE=XA1: | A=01032999 |
| *TIME=16451 | STATE=XA1: | A=01033000 |
| *TIME=16516 | STATE=XA1: | A=01033999 |
| *TIME=16580 | STATE=XA1: | A=01034000 |
| *TIME=16645 | STATE=XA1: | A=01034999 |
| *TIME=16709 | STATE=XA1: | A=01035000 |
| *TIME=16774 | STATE=XA1: | A=01035999 |
| *TIME=16888 | STATE=XA1: | A=01040000 |
| *TIME=16903 | STATE=XA1: | A=01040999 |
| *TIME=16967 | STATE=XA1: | A=01041000 |
| *TIME=17032 | STATE=XA1: | A=01041999 |
| *TIME=17096 | STATE=XA1: | A=01042000 |
| *TIME=17161 | STATE=XA1: | A=01042999 |
| *TIME=17225 | STATE=XA1: | A=01043000 |
| *TIME=17290 | STATE=XA1: | A=01043999 |
| *TIME=17354 | STATE=XA1: | A=01044000 |
| *TIME=17419 | STATE=XA1: | A=01044999 |
| *TIME=17483 | STATE=XA1: | A=01045000 |
| *TIME=17548 | STATE=XA1: | A=01045999 |
| *TIME=17612 | STATE=XA1: | A=01050000 |
| *TIME=17677 | STATE=XA1: | A=01050999 |
| *TIME=17741 | STATE=XA1: | A=01051000 |
| *TIME=17806 | STATE=XA1: | A=01051999 |
| *TIME=17870 | STATE=XA1: | A=01052000 |
| *TIME=17935 | STATE=XA1: | A=01052999 |
| *TIME=17999 | STATE=XA1: | A=01053000 |
| *TIME=18064 | STATE=XA1: | A=01053999 |
| *TIME=18128 | STATE=XA1: | A=01054000 |
| *TIME=18193 | STATE=XA1: | A=01054999 |
| *TIME=18257 | STATE=XA1: | A=01055000 |
| *TIME=18322 | STATE=XA1: | A=01055999 |
| *TIME=18386 | STATE=XA1: | A=01060000 |
| *TIME=18451 | STATE=XA1: | A=01060999 |
| *TIME=18515 | STATE=XA1: | A=01061000 |
| *TIME=18580 | STATE=XA1: | A=01061999 |
| *TIME:=18644 | STATE=XA1: | A=01062000 |
| *TIME=18709 | STATE=XA1: | A=01062999 |
| *TIME=18773 | STATE=XA1: | A=01063000 |
| *TIME=18838 | STATE=XA1: | A=01063999 |
| *TIME=18902 | STATE=XA1: | A=01064000 |
| *TIME=18967 | STATE=XA1: | A=01064999 |
| *TIME=19031 | STATE=XA1: | A=01065000 |
| *TIME=19098 | STATE=XA1: | A=01065999 |

-continued

| | | |
|---|---|---|
| *TIME=19160 | STATE=XA1: | A=01070000 |
| *TIME=19225 | STATE=XA1: | A=01070999 |
| *TIME=19289 | STATE=XA1: | A=01071000 |
| *TIME=19354 | STATE=XA1: | A=01071999 |
| *TIME=19418 | STATE=XA1: | A=01072000 |
| *TIME=19483 | STATE=XA1: | A=01072999 |
| *TIME=19547 | STATE=XA1: | A=01073000 |
| *TIME=19612 | STATE=XA1: | A=01073999 |
| *TIME=19676 | STATE=XA1: | A=01074000 |
| *TIME=19741 | STATE=XA1: | A=01074999 |
| *TIME=19805 | STATE=XA1: | A=01075000 |
| *TIME=19870 | STATE=XA1: | A=01075999 |
| *TIME=19934 | STATE=XA1: | A=01080000 |
| *TIME=19999 | STATE=XA1: | A=01080999 |
| *TIME=20063 | STATE=XA1: | A=01081000 |
| *TIME=20128 | STATE=XA1: | A=01081999 |
| *TIME=20192 | STATE=XA1: | A=01082000 |
| *TIME=20257 | STATE=XA1: | A=01082999 |
| *TIME=20321 | STATE=XA1: | A=01083000 |
| *TIME=20386 | STATE=XA1: | A=01083999 |
| *TIME=20450 | STATE=XA1: | A=01084000 |
| *TIME=20515 | STATE=XA1: | A=01084999 |
| *TIME=20579 | STATE=XA1: | A=01085000 |
| *TIME=20644 | STATE=XA1: | A=01085999 |
| *TIME=20708 | STATE=XA1: | A=01090000 |
| *TIME=20773 | STATE=XA1: | A=01090999 |
| *TIME=20837 | STATE=XA1: | A=01091000 |
| *TIME=20902 | STATE=XA1: | A=01091999 |
| *TIME=20966 | STATE=XA1: | A=01092000 |
| *TIME=21031 | STATE=XA1: | A=01092999 |
| *TIME=21095 | STATE=XA1: | A=01093000 |
| *TIME=21160 | STATE=XA1: | A=01093999 |
| *TIME=21224 | STATE=XA1: | A=01094000 |
| *TIME=21289 | STATE=XA1: | A=01094999 |
| *TIME=21353 | STATE=XA1: | A=01095000 |
| *TIME=21418 | STATE=XA1: | A=01095999 |
| *TIME=21482 | STATE=XA1: | A=01100000 |
| *TIME=21547 | STATE=XA1: | A=01100999 |
| *TIME=21611 | STATE=XA1: | A=01101000 |
| *TIME=21676 | STATE=XA1: | A=01101999 |
| *TIME=21740 | STATE=XA1: | A=01102000 |
| *TIME=21805 | STATE=XA1: | A=01102999 |
| *TIME=21869 | STATE=XA1: | A=01103000 |
| *TIME=21934 | STATE=XA1: | A=01103999 |
| *TIME=21998 | STATE=XA1: | A=01104000 |
| *TIME=22063 | STATE=XA1: | A=01104999 |
| *TIME=22127 | STATE=XA1: | A=01105000 |
| *TIME=22192 | STATE=XA1: | A=01105999 |
| *TIME=22256 | STATE=XA1: | A=01110000 |
| *TIME=22321 | STATE=XA1: | A=01110999 |
| *TIME=22385 | STATE=XA1: | A=01111000 |
| *TIME=22450 | STATE=XA1: | A=01111999 |
| *TIME=22514 | STATE=XA1: | A=01112000 |
| *TIME=22579 | STATE=XA1: | A=01112999 |
| *TIME=22643 | STATE=XA1: | A=01113000 |
| *TIME=22708 | STATE=XA1: | A=01113999 |
| *TIME=22772 | STATE=XA1: | A=01114000 |
| *TIME=22837 | STATE=XA1: | A=01114999 |
| *TIME=22901 | STATE=XA1: | A=01115000 |
| *TIME=22966 | STATE=XA1: | A=01115999 |
| *TIME=23030 | STATE=XA1: | A=01120000 |
| *TIME=23095 | STATE=XA1: | A=01120999 |
| *TIME=23159 | STATE=XA1: | A=01121000 |
| *TIME=23224 | STATE=XA1: | A=01121999 |
| *TIME=23288 | STATE=XA1: | A=01122000 |
| *TIME=23353 | STATE=XA1: | A=01122999 |
| *TIME=23417 | STATE=XA1: | A=01123000 |
| *TIME=23482 | STATE=XA1: | A=01123999 |
| *TIME=23546 | STATE=XA1: | A=01124000 |
| *TIME=23611 | STATE=XA1: | A=01124999 |
| *TIME=23675 | STATE=XA1: | A=01125000 |
| *TIME=23740 | STATE=XA1: | A=01125999 |
| *TIME=23804 | STATE=XA1: | A=01130000 |
| *TIME=23869 | STATE=XA1: | A=01130999 |
| *TIME=23933 | STATE=XA1: | A=01131000 |
| *TIME=23998 | STATE=XA1: | A=01131999 |
| *TIME=24062 | STATE=XA1: | A=01132000 |
| *TIME=24127 | STATE=XA1: | A=01132999 |
| *TIME=24191 | STATE=XA1: | A=01133000 |
| *TIME=24256 | STATE=XA1: | A=01133999 |
| *TIME=24320 | STATE=XA1: | A=01134000 |
| *TIME=24385 | STATE=XA1: | A=01134999 |
| *TIME=24449 | STATE=XA1: | A=01135000 |
| *TIME=24514 | STATE=XA1: | A=01135999 |
| *TIME=24578 | STATE=XA1: | A=01140000 |
| *TIME=24643 | STATE=XA1: | A=01140999 |
| *TIME=24707 | STATE=XA1: | A=01141000 |
| *TIME=24772 | STATE=XA1: | A=01141999 |
| *TIME=24836 | STATE=XA1: | A=01142000 |
| *TIME=24901 | STATE=XA1: | A=01142999 |
| *TIME=24965 | STATE=XA1: | A=01143000 |
| *TIME=25030 | STATE=XA1: | A=01143999 |
| *TIME=25094 | STATE=XA1: | A=01144000 |

-continued

| | | |
|---|---|---|
| *TIME=25159 | STATE=XA1: | A=01144999 |
| *TIME=25223 | STATE=XA1: | A=01145000 |
| *TIME=25288 | STATE=XA1: | A=01145999 |
| *TIME=25352 | STATE=XA1: | A=01150000 |
| *TIME=25417 | STATE=XA1: | A=01150999 |
| *TIME=25481 | STATE=XA1: | A=01151000 |
| *TIME=25546 | STATE=XA1: | A=01151999 |
| *TIME=25610 | STATE=XA1: | A=01152000 |
| *TIME=25675 | STATE=XA1: | A=01152999 |
| *TIME=25739 | STATE=XA1: | A=01153000 |
| *TIME=25804 | STATE=XA1: | A=01153999 |
| *TIME=25868 | STATE=XA1: | A=01154000 |
| *TIME=25933 | STATE=XA1: | A=01154999 |
| *TIME=25997 | STATE=XA1: | A=01155000 |
| *TIME=26062 | STATE=XA1: | A=01155999 |
| *TIME=26126 | STATE=XA1: | A=01160000 |
| *TIME=26191 | STATE=XA1: | A=01160999 |
| *TIME=26255 | STATE=XA1: | A=01161000 |
| *TIME=26320 | STATE=XA1: | A=01161999 |
| *TIME=26384 | STATE=XA1: | A=01162000 |
| *TIME=26449 | STATE=XA1: | A=01162999 |
| *TIME=26513 | STATE=XA1: | A=01163000 |
| *TIME=26578 | STATE=XA1: | A=01163999 |
| *TIME=26642 | STATE=XA1: | A=01164000 |
| *TIME=26707 | STATE=XA1: | A=01164999 |
| *TIME=26771 | STATE=XA1: | A=01165000 |
| *TIME=26836 | STATE=XA1: | A=01165999 |
| *TIME=26900 | STATE=XA1: | A=01170000 |
| *TIME=26965 | STATE=XA1: | A=01170999 |
| *TIME=27029 | STATE=XA1: | A=01171000 |
| *TIME=27094 | STATE=XA1: | A=01171999 |
| *TIME=27158 | STATE=XA1: | A=01172000 |
| *TIME=27223 | STATE=XA1: | A=01172999 |
| *TIME=27287 | STATE=XA1: | A=01173000 |
| *TIME=27352 | STATE=XA1: | A=01173999 |
| *TIME=27416 | STATE=XA1: | A=01174000 |
| *TIME=27481 | STATE=XA1: | A=01174999 |
| *TIME=27545 | STATE=XA1: | A=01175000 |
| *TIME=27610 | STATE=XA1: | A=01175999 |
| *TIME=27674 | STATE=XA1: | A=01180000 |
| *TIME=27739 | STATE=XA1: | A=01180999 |
| *TIME=27803 | STATE=XA1: | A=01181000 |
| *TIME=27868 | STATE=XA1: | A=01181999 |
| *TIME=27932 | STATE=XA1: | A=01182000 |
| *TIME=27997 | STATE=XA1: | A=01182999 |
| *TIME=28061 | STATE=XA1: | A=01183000 |
| *TIME=28126 | STATE=XA1: | A=01183999 |
| *TIME=28190 | STATE=XA1: | A=01184000 |
| *TIME=28255 | STATE=XA1: | A=01184999 |
| *TIME=28319 | STATE=XA1: | A=01185000 |
| *TIME=28384 | STATE=XA1: | A=01185999 |
| *TIME=28448 | STATE=XA1: | A=01190000 |
| *TIME=28513 | STATE=XA1: | A=01190999 |
| *TIME=28577 | STATE=XA1: | A=01191000 |
| *TIME=28642 | STATE=XA1: | A=01191999 |
| *TIME=28706 | STATE=XA1: | A=01192000 |
| *TIME=28771 | STATE=XA1: | A=01192999 |
| *TIME=28835 | STATE=XA1: | A=01193000 |
| *TIME=28900 | STATE=XA1: | A=01193999 |
| *TIME=28964 | STATE=XA1: | A=01194000 |
| *TIME=29029 | STATE=XA1: | A=01194999 |
| *TIME=29093 | STATE=XA1: | A=01195000 |
| *TIME=29158 | STATE=XA1: | A=01195999 |
| *TIME=29222 | STATE=XA1: | A=01200000 |
| *TIME=29287 | STATE=XA1: | A=01200999 |
| *TIME=29351 | STATE=XA1: | A=01201000 |
| *TIME=29416 | STATE=XA1: | A=01201999 |
| *TIME=29480 | STATE=XA1: | A=01202000 |
| *TIME=29545 | STATE=XA1: | A=01202999 |
| *TIME=29609 | STATE=XA1: | A=01203000 |
| *TIME=29674 | STATE=XA1: | A=01203999 |
| *TIME=29738 | STATE=XA1: | A=01204000 |
| *TIME=29803 | STATE=XA1: | A=01204999 |
| *TIME=29867 | STATE=XA1: | A=01205000 |
| *TIME=29932 | STATE=XA1: | A=01205999 |
| *TIME=29996 | STATE=XA1: | A=01210000 |
| *TIME=30061 | STATE=XA1: | A=01210999 |
| *TIME=30125 | STATE=XA1: | A=01211000 |
| *TIME=30190 | STATE=XA1: | A=01211999 |
| *TIME=30254 | STATE=XA1: | A=01212000 |
| *TIME=30319 | STATE=XA1: | A=01212999 |
| *TIME=30383 | STATE=XA1: | A=01213000 |
| *TIME=30448 | STATE=XA1: | A=01213999 |
| *TIME=30512 | STATE=XA1: | A=01214000 |
| *TIME=30577 | STATE=XA1: | A=01214999 |
| *TIME=30641 | STATE=XA1: | A=01215000 |
| *TIME=30706 | STATE=XA1: | A=01215999 |
| *TIME=30770 | STATE=XA1: | A=01220000 |
| *TIME=30835 | STATE=XA1: | A=01220999 |
| *TIME=30899 | STATE=XA1: | A=01221000 |
| *TIME=30964 | STATE=XA1: | A=01221999 |
| *TIME=31028 | STATE=XA1: | A=01222000 |
| *TIME=31093 | STATE=XA1: | A=01222999 |

-continued

```
*TIME=31157   STATE=XA1:  A=01223000
*TIME=31222   STATE=XA1:  A=01223999
*TIME=31286   STATE=XA1:  A=01224000
*TIME=31351   STATE=XA1:  A=01224999
*TIME=31415   STATE=XA1:  A=01225000
*TIME=31480   STATE=XA1:  A=01225999
*TIME=31544   STATE=XA1:  A=01230000
*TIME=31609   STATE=XA1:  A=01230999
*TIME=31673   STATE=XA1:  A=01231000
*TIME=31738   STATE=XA1:  A=01231999
*TIME=31802   STATE=XA1:  A=01232000
*TIME=31867   STATE=XA1:  A=01232999
*TIME=31931   STATE=XA1:  A=01233000
*TIME=31996   STATE=XA1:  A=01233999
*TIME=32060   STATE=XA1:  A=01234000
*TIME=32125   STATE=XA1:  A=01234999
*TIME=32189   STATE=XA1:  A=01235000
*TIME=32254   STATE=XA1:  A=01235999
*TIME=32318   STATE=XA1:  A=01240000
*TIME=32383   STATE=XA1:  A=01240999
*TIME=32447   STATE=XA1:  A=01241000
*TIME=32512   STATE=XA1:  A=01241999
*TIME=32576   STATE=XA1:  A=01242000
*TIME=32641   STATE=XA1:  A=01242999
*TIME=32705   STATE=XA1:  A=01243000
*TIME=2       STATE=XA1:  A=01243999
*TIME=66      STATE=XA1:  A=01244000
*TIME=131     STATE=XA1:  A=01244999
*TIME=195     STATE=XA1:  A=01245000
*TIME=260     STATE=XA1:  A=01245999
*TIME=324     STATE=XA1:  A=01250000
*TIME=389     STATE=XA1:  A=01250999
*TIME=453     STATE=XA1:  A=01251000
*TIME=518     STATE=XA1:  A=01251999
*TIME=582     STATE=XA1:  A=01252000
*TIME=647     STATE=XA1:  A=01252999
*TIME=711     STATE=XA1:  A=01253000
*TIME=776     STATE=XA1:  A=01253999
*TIME=840     STATE=XA1:  A=01254000
*TIME=905     STATE=XA1:  A=01254999
*TIME=969     STATE=XA1:  A=01255000
*TIME=1034    STATE=XA1:  A=01255999
*TIME=1098    STATE=XA1:  A=01260000
*TIME=1163    STATE=XA1:  A=01260999
*TIME=1227    STATE=XA1:  A=01261000
*TIME=1292    STATE=XA1:  A=01261999
*TIME=1356    STATE=XA1:  A=01262000
*TIME=1421    STATE=XA1:  A=01262999
*TIME=1485    STATE=XA1:  A=01263000
*TIME=1550    STATE=XA1:  A=01263999
```

DIGITAL SIMULATION SYSTEM

```
 1
 2   "TIMING,A,B,D REGISTER SIMULATION"
 3  REGISTER
 4    DATE,ACR,AB[1:3],A[1:32],D[1:32],DB[1:3],DCR,M31,
 5    PL1,H24,READ,B[1:32],BCR,BBB[1:3],HMS,
 6    TIMM[6:1],SYNCA,QA1,
 7    XKA,XKB,XK[6:1],XT[5:1],CT[3:1].
 8  TERMINAL
 9    JDATE,KDATE,AA[1:4],ABI[1:4],SR1,AI,AAA,AAB,AAC,SA,TA,PPG,P1,P2,P3
10    SYNC,SYNCB,DACR,XKK,DDCR,SD,IM31,DK,DP1,DD[1:4],DAA,DAB,DAC,
11    ADCL,ECLOCK,ACLOCK,BCLOCK,CCLOCK,DCLOCK,DBI[1:4],DI,TDD,
12    PHASEONE,PHASETWO,CLX,JXK4,KXK4,
13    TD[1:9],TE0,TE2,TL6,TE7,TE6,TM4,TM1,TETTM4,TITE7,PX[1:3],TE1,TE3,
14    BAA,BAB,BAC,BB[1:4],BBI[1:4],TB,SB,BI,SR2,DBCR,
15    JXK5,KXK5,JXK6,KXK6,SLOCK.
16  OPERATION
17    SET=[DCR=1B1,BCR=1B1],
18    LOAD=[
19      ↑D[25:32](=)1↑D[29]=1B1,D[27]=1B1.,
20      A[1]_1B1,A[4]_1B1,A[7]_1B1,A[8]_1B0,
21      A[13]_1B1,A[18]_1B1,A[16]_1B1,A[20]_1B1,A[10]_1B1,A[12]_1B1,
22        B[21]_1B1,B[24]_1B1,B[25]_1B1,B[28]_1B1,B[29]_1B1,B[32]_1B1,
23        A[21]_1B1,A[24]_1B1,A[25]_1B1,A[28]_1B1,A[29]_B1,A[32]_1B1],
24    GO=[
25          TE0=-XT5*-XT4*-XT3,
26          TE1=-XT5*-XT4*XT3,
27          TE2=-XT5*XT4*-XT3,
28          TE3=-XT5*XT4*XT3,
29          TL6=XT3*XT4+XT3*XT5,
30          TE7=XT5*XT4*XT3,
31          TE6=XT5*XT4*-XT3,
32          TM4=XT2*XT1,
33          TM1=-XT2*-XT1,
34          TETTM4=XT5*XT4*XT3*XT2*XT1,
35          TITE7=-(XT5*XT4*XT3*-XT2*XT1),
36          AAA=-(-A32+-ACR), DAA=-(-D32+DCR), BAA=-(-B32+BCR),
37          AAB=-(-A31+-AAA), DAB=-(-D31+-DAA), BAB=-(-B31+-BAA),
38          AAC=-(-A30+-AAB), DAC=-(-D30+-DAB), BAC=-(-B30+-BAB),
39          AA1=-(A32*ACR+-A32*-ACR), DD1=-(D32*-DCR+-D32*DCR),
40          AA2=-(A31*AAA+-A31*-AAA), DD2=-(D31*DAA+-D31*-DAA),
41          AA3=-(A30*AAB+-A30*-AAB), DD3=-(D30*DAB+-D30*-DAB),
```

-continued

```
42          AA4=-(A29*AAC+-A29*-AAC), DD4=-(D29*DAC+-D29*-DAC),
43          BB1=-(B32*-BCR+-B32*BCR), BB2=-(B31*BAA+-B31*-BAA),
44          BB3=-(B30*BAB+-B30*-BAB), BB3=-(B29*BAC+-B29*-BAC),
45          P1=-(H24+-(TE6*A28*AA1*AA2)),
46          P2=TE7*AA1*AA2,
47          P3=TE6*A27*AA3,
48          PPG=(AA2*TE7*-H24*TM4),
49          TA=-(P2+P3+TL6*AA2*AA3+AA2*AA4+PPG+P1),
50          IM31=-(-D28*DD1*-DD4+-D28*-DD1*DD4+-DD1*D28),
51          ↑TM4*TE2↑M31-IM31.,
52          PX1=-(DD1*DD2*TE2),
53          PX2=-(D27*TE0),
54          PX3=-(DD2+(DD1*M31)),
55          DK=-(PX1*PX2+PX1*PX3),
56          DP1=D28*DK+DD4*TE7,
57          TDD=-(DD2*DD4+DP1+TE1*DD3+TE3*DD2),
58          TB=-(BB2*BB4+BB2*BB3*TL6*HMS),
59          SA=-TM4*ta), SD=-(TM4*TDD), SB=-(TM4*TB),
60          KDATE=TE7*TM4,
61          JDATE=-(PL1+-(P2+(AA4*PPG)))*TM4,
62          DATE_↑ JDATE CON KDATE↑1D0;1D1;-DATE;DATE.,
63          ABI1=AA4*-SA+-(AA4+-PPG)*SA, DBI1=DD4*-SD, BBI1=BB4*-SB,
64          ABI2=AA3*-SA+AB1*SA, DBI2=DD3*-SD+DB1*SD, BBI2=BB3*-SB+BBB1*SB,
65          ABI3=AA2*-SA+AB2*SA, DBI3=DD2*-SD+DB2*SD, BBI3=BB2*-SB+BBB2*SB,
66          ABI4=AA1*-SA+AB3*SA, DBI4=DD1*-SD+DB3*SD, BBI4=BB1*-SB+BBB3*SB,
67          DACR=-(-(PL1*TE6)*-(TE7+SA)), DBCR=-(TE7+SB),
68          DDCR=-(DATE*TE6+JDATE*TE7+DD2*DD4+D28*DK+TE1*DD3+TE3*DD2),
69          ↑TM4↑ACR_DACR.,↑TM4↑DCR_DDCR., ↑TM4↑BCR_BDCR.,
70          AI=TM4*P1+ABI4, DI=TM4*DP1+DBI4, BI=BBI4,
71          SLOCK=1B1,
72          ↑SLOCK↑AB1_ABI1, AB2_ ABI2,AB3_ ABI3,DB1_DBI1,DB2_DBI2,DB3_DBI3,
73          BBB1_ BBI1,BBB2 _BBI2,BBB3_ BBI3.,
74          ↑SLOCK↑XT1_-XT1.,
75          ↑SLOCK*XT1↑XT2  -XT2.,
76          ↑SLOCK*XT1*XT2↑XT3 _-XT3.,
77          ↑SLOCK*XT1*XT2*XT3 XT4_-XT4.,
78          ↑SLOCK*XT1*XT2*XT3*XT4 XT5_-XT5.,
79          A_AI CON A[1:31], D  DI CON D[1:31], B_BI CON B[1:31],
80          QA1=XT(=)2*A31*-A30*-A29*-A28*-A32*-A3*3-A6,
81          ↑XT(=)3↑OUTPUT(6,B).
82          ].
83  CONTROL
84    XAS:SET,->XA1/
85    XA1:GO,->XA2/
86    XA2:↑QA1↑->XA3;->XA1./
87    XA3:LOAD,->XA1/.$
END OF TRANSLATION, 0 ERRORS.

*TIME=7      STATE=XA1: B=00000000000000000000000000000000
*TIME=71     STATE=XA1: B=00000000
*TIME=136    STATE=XA1: B=00000999
*TIME=200    STATE=XA1: B=00001000
*TIME=265    STATE=XA1: B=00001999
*TIME=329    STATE=XA1: B=00002000
*TIME=394    STATE=XA1: B=00002999
*TIME=458    STATE=XA1: B=00003000
*TIME=523    STATE=XA1: B=00003999
*TIME=587    STATE=XA1: B=00004000
*TIME=652    STATE=XA1: B=00004999
*TIME=716    STATE=XA1: B=00005000
*TIME=781    STATE=XA1: B=00005999
*TIME=845    STATE=XA1: B=00006000
*TIME=910    STATE=XA1: B=00006999
*TIME=974    STATE=XA1: B=00007000
*TIME=1039   STATE=XA1: B=00007999
*TIME=1103   STATE=XA1: B=00008000
*TIME=1168   STATE=XA1: B=00008999
*TIME=1232   STATE=XA1: B=00009000
*TIME=1297   STATE=XA1: B=00009999
*TIME=1361   STATE=XA1: B=00010000
*TIME=1426   STATE=XA1: B=00010999
*TIME=1490   STATE=XA1: B=00011000
*TIME=1555   STATE=XA1: B=00011999
*TIME=1619   STATE=XA1: B=00012000
*TIME=1684   STATE=XA1: B=00012999
*TIME=1748   STATE=XA1: B=00013000
*TIME=1813   STATE=XA1: B=00013999
*TIME=1877   STATE=XA1: B=00014000
*TIME=1942   STATE=XA1: B=00014999
*TIME=2006   STATE=XA1: B=00015000
*TIME=2071   STATE=XA1: B=00015999
*TIME=2135   STATE=XA1: B=00016000
*TIME=2200   STATE=XA1: B=00016999
*TIME=2264   STATE=XA1: B=00017000
*TIME=2329   STATE=XA1: B=00017999
*TIME=2393   STATE=XA1: B=00018000
*TIME=2458   STATE=XA1: B=00018999
*TIME=2522   STATE=XA1: B=00019000
*TIME=2587   STATE=XA1: B=00019999
*TIME=2651   STATE=XA1: B=00020000
*TIME=2716   STATE=XA1: B=00020999
*TIME=2780   STATE=XA1: B=00021000
*TIME=2845   STATE=XA1: B=00021999
```

-continued

```
*TIME=2909   STATE=XA1:  B=00022000
*TIME=2974   STATE=XA1:  B=00022999
*TIME=3038   STATE=XA1:  B=00023000
*TIME=3103   STATE=XA1:  B=00023999
*TIME=3167   STATE=XA1:  B=00024000
*TIME=3232   STATE=XA1:  B=00024999

*TIME=1      STATE=XA1:  B=00000000000000100101000000000000
*TIME=65     STATE=XA1:  B=00025000
*TIME=130    STATE=XA1:  B=00025999
*TIME=194    STATE=XA1:  B=00030000
*TIME=259    STATE=XA1:  B=00030999
*TIME=323    STATE=XA1:  B=00031000
*TIME=388    STATE=XA1:  B=00031999
*TIME=452    STATE=XA1:  B=00032000
*TIME=517    STATE=XA1:  B=00032999
*TIME=581    STATE=XA1:  B=00033000
*TIME=646    STATE=XA1:  B=00033999
*TIME=710    STATE=XA1:  B=00034000
*TIME=775    STATE=XA1:  B=00034999
*TIME=839    STATE=XA1:  B=00035000
*TIME=904    STATE=XA1:  B=00035999
*TIME=968    STATE=XA1:  B=00040000
*TIME=1033   STATE=XA1:  B=00040999
*TIME=1097   STATE=XA1:  B=00041000
*TIME=1162   STATE=XA1:  B=00041999
*TIME=1226   STATE=XA1:  B=00042000
*TIME=1291   STATE=XA1:  B=00042999

DIGITAL SIMULATION SYSTEM
 1
 2    "TIMING,A,B,D REGISTER SIMULATION"
 3  REGISTER
 4    DATE,ACR,AB[1:3],A[1:32],D[1:32],DB[1:3],DCR,M31,
 5    PL1,H24,READ,B[1:32],BCR,BBB[1:3],HMS,
 6    TIMM[6:1],SYNCA,QA1,
 7    XKA,XKB,XK[6:1],XT[5:1],CT[3:1].
 8  TERMINAL
 9    JDATE,KDATE,AA[1:4],ABI[1:4],SR1,AI,AAA,AAB,AAC,SA,TA,PPG,P1,P2,P3
10    SYNC ,SYNCB,DACR,XKK,DDCR,SD,IM31,DK,DP1,DD[1:4],DAA,DAB,DAC,
11    ADCL,ECLOCK,ACLOCK,BCLOCK,CCLOCK,DCLOCK,DBI[1:4],DI,TDD.
12    PHASEONE,PHASETWO, CLX,JXK4,KXK4,
13    TD[1:9],TE0,TE2,TL6,TE7,TE6,TM4,TM1,TETTM4,TITE7, PX[1:3],TE1,TE3,
14    BAA,BAB,BAC,BB[1:4],BBI[1:4],TB,SB,BI,SR2,DBCR,
15    JXK5,KXK5,JXK6,KXK6,SLOCK.
16  OPERATION
17    SET=[DCR=1B1,BCR=1B1],
18    LOAD=[
19      ↑D[25:32](=)1↑D[29]=1B1,D[27]—1B1.,
20      A[1]_1B1,A[4]_1B1,A[7]_1B1,A[8]_1B0,
21      A[13]_1B1,A[18]_1B1,A[16]_1B1,A[20]_1B1,A[10]_1B1,A[12]_1B1,
22        A[21] _1B1,A[24]_1B1,A[25]_1B1,A[28]_1B1,A[29]_1B1,A[32] _1B1],
23    GO=[
24          Te0=—XT5*—XT4*—XT3,
25          TE1=—XT4*XT3,
26          TE2=—XT5*XT4*—XT3,
27          TE3=—XT5*XT4*XT3,
28          TL6=XT3*XT4+XT3*XT5,
29          TE7=XT5*XT4*XT3,
30          TE6=XT5*XT4*—XT3,
31          TM4=XT2*XT1,
32          TM1=XT2*—XT1,
33          TETTM4=XT5*XT4*XT3*XT2*XT1,
34          TITE7=—(XT5*XT4*XT3:—XT2*XT1),
35          AAA=—(—A32+—ACR), DAA=—(—D32+ DCR), BAA=—(—B32+ BCR),
36          AAB=—(—A31+—AAA), DAB=—(—D31+—DAA), BAB=—(—B31+—BAA),
37          AAC=—(—A30+—AAB), DAC=—(—D30+—DAB), BAC=—(—B30+—BAB),
38          AA1=—(A32*ACR+—A32*—ACR), DD1=—(D32*—DCR+—D32*DCR),
39          AA2=—(A31*AAA+—A31*—AAA), DD2=—(D31*DAA+—D31*—DAA),
40          AA3=—(A30*AAB+—A30*—A30*—AAB), DD3=—(D30*DAB+—D30*—DAB),
41          AA4=—(A29*AAC+—A29*—AAC), DD4=—(D29*DAC+—D29*—DAC),
42          BB1=—(B32*—BCR+—B32*BCR), BB2=—(B31*BAA+—B31*-BAA),
43          BB3+—(B30*BAB+—B30*—BAB), BB4=—(B29*BAC+—B29*—BAC),
44          P1=—(H24+—(TE6*A28*AA1*AA2)),
45          P2=TE7*AA1*AA2,
46          P3=TE6*A27*AA3,
47          PPG= (AA2*TE7*—H24*TM4),
48          TA=—(P2+P3+TL6*AA2*AA3+AA2*AA4+PPG+P1),
49          IM31=—(—D28*DD1*—DD4+—D28*—DD1*DD4+—DD1*D28),
50          ↑TM4*TE2↑M31_IM31.,
51          PX1=—(DD1*DD2*TE2),
52          PX2=—(D27:TE0),
53          PX3=—(DD2+(DD1* M31)),
54          DK=—(PX1*PX2+PX1*PX3),
55          DP1=D28*DK+DD4*TE7,
56          TDD=—(DD2*DD4+DP1+TE1*DD3+TE3*DD2),
57          TB=—(BB2*BB4+BB2*BB3*TE6*HMS),
58          SA=—(TM4*TA), SD=—(TM4*TDD), SB=—(TM4*TB),
59          KDATE=TE7*TM4,
60          JDATE=—(PL1+—(P2+(AA4*PPG)))*TM4,
61          DATE_↑JDATE CON KDATE↑1D0;1D1;—DATE;DATE.,
62          ABI1=AA4*—SA+—(AA4+—PPG)*SA, DBI1—DD4*—SD, BBI1=BB4*—SB,
63          ABI2=AA3*—SA+AB1*SA, DBI2=DD3*—SD+DB1*SD, BBI2=BB3*—SB+BBB1*SB,
```

-continued

```
64          ABI3=AA2*−SA+AB2*SA, DBI3=DD2*−SD+DB2*SD, BBI3=BB2*−SB+BBB2:SB,
65          ABI4=AA1*−SA+AB3*SA, DBI4=DD1*−SD+DB3*SD, BBI4=BB1*−SB+BBB3*SB,
66          DACR=−(−(PL1*TE6)*−(TE7+SA)), DBCR=−(TE7+SB),
67          DDCR=−(DATE*TE6+JDATE*TE7+DD2+DD4+D28*DK+TE1*DD3+TE3*DD2),
68          ↑TM4↑ACR  DACR., ↑TM4↑DCR  DDCR., ↑TM4↑BCR  DBCR.,
69          AI=TM4*P1+ABI4, DI=TM4*DP1+DBI4, BI=BBI4,
70          Slock=1B1,
71          ↑SLOCK AB1_ ABI1,AB2_ ABI2,AB3_ ABI3,DB1_ DBI1,DB2 _DBI2,DB3_DBI3,
72          BBB1_ BBI1,BBB2_BBI2,BBB3_ BBI3.,
73          ↑SLOCK↑XT1 _−XT1.,
74          ↑SLOCK*XT1↑XT2_−XT2.,
75          ↑SLOCK*XT1*XT2↑XT3_.−XT3.,
76          ↑SLOCK*XT1*XT2*XT3↑XT4_−XT4.,
77          ↑SLOCK*XT1*XT2*XT3*XT4↑XT5'_−XT5.,
78          A_AI CON A[1:31], D_ DI CON D[1:31], B_BI CON B[1:31],
79          QA1=XT(=)2*A31*−A30*−A29*−A28*−A32*−A3*−A6,
80          ↑XT(=)3*DATE↑OUTPUT(6,A,D,B).
81          ].
82  CONTROL
83    XAS:SET,−>XA1/
84    XA1:GO,−>XA2/
85    XA2:↑QA1↑−>XA3;−>XA1./
86    XA3:LOAD,−>XA1/.$
END OF TRANSLATION, 0 ERRORS.

*TIME=0     STATE=XAS: A=01000000  D=19730129  XT=03
*TIME=194   STATE=XA1: A=01000000  D=19730129
*TIME=323   STATE=XA1: A=01000000  D=29730130
*TIME=452   STATE=XA1: A=01000000  D=39730131
*TIME=581   STATE=XA1: A=01000000  D−49730229
*TIME=710   STATE=XA1: A=01000000  D=59730230
*TIME=839   STATE=XA1: A=01000000  D=69730329
*TIME=968   STATE=XA1: A−01000000  D=79730330
*TIME=1097  STATE=XA1: A=01000000  D=19730331
*TIME=1226  STATE=XA1: A=01000000  D=29730429
*TIME=1355  STATE=XA1: A=01000000  D=39730430
*TIME=1484  STATE=XA1: A=01000000  D=49730529
*TIME=1613  STATE=XA1: A=01000000  D=59730530
*TIME=1742  STATE=XA1: A=01000000  D=69730531
*TIME=1871  STATE=XA1: A=01000000  D=79730629
*TIME=2000  STATE=XA1: A=01000000  D=19730630
*TIME=2129  STATE=XA1: A=01000000  D=29730729
*TIME=2258  STATE=XA1: A=01000000  D=39730730
*TIME=2387  STATE=XA1: A=01000000  D=49730731
*TIME=2516  STATE=XA1: A=01000000  D=59730829
*TIME=2645  STATE=XA1: A=01000000  D=69730830
*TIME=2774  STATE=XA1: A=01000000  D=79730831
*TIME=2903  STATE=XA1: A=01000000  D=19730929
*TIME=3032  STATE=XA1: A=01000000  D=29730930
*TIME=3161  STATE=XA1: A=01000000  D=39731029
*TIME=3290  STATE=XA1: A=01000000  D=49731030
*TIME=3419  STATE=XA1: A=01000000  D=59731031
*TIME=3548  STATE=XA1: A=01000000  D=69731129
*TIME=3677  STATE=XA1: A=01000000  D=79731130
*TIME=3935  STATE=XA1: A=01000000  D=29731229
*TIME=4064  STATE=XA1: A=01000000  D=39731230
*TIME=4193  STATE=XA1: A=01000000  D=49731231
*TIME=4322  STATE=XA1: A=01000000  D=59740129
*TIME=4451  STATE=XA1: A−01000000  D=69740130
*TIME=4580  STATE=XA1: A=01000000  D=79740131
*TIME=4709  STATE=XA1: A=01000000  D=19740229
*TIME=4838  STATE=XA1: A=01000000  D=29740230
*TIME=4967  STATE=XA1: A=01000000  D=39740329
```

We claim:

1. A circulating shift register time-keeping circuit comprising:

timing means for producing a plurality of timing signals;

control means for producing a plurality of control signals;

storage means having a circulating shift register memory for storing time data representing progressively larger units of time, said time data circulating in the memory at a preselected rate in response to timing signals from the timing means, a binary adder coupled to the memory for incrementing the time data circulating therein, an auxiliary register coupled to the memory for storing incremented time data therein, and an adder controller coupled to the binary adder and auxiliary register and responsive to timing and control signals from the timing and control means, respectively, for causing the binary adder to periodically increment the time data representing the smallest unit of time circulating in the memory and to periodically increment the time data representing remaining progressively larger units of time circulating in the memory when the time data representing the largest preceding unit of time relative thereto equals preselected values and for causing the auxiliary register to modify the value of the incremented time data stored therein when that time data equals said preselected values; and display means coupled to the storage means for displaying the time data stored therein.

2. A circulating shift register time-keeping circuit as in claim 1 wherein:

the preselected rate of time data circulation is approximately 3.2 KHz;

the smallest unit of time is hundredths-of-seconds;

the next largest unit of time is tenths-of tenths-of-seconds;
the next largest unit of time is seconds;
the next largest unit of time is tens-of-seconds;
the next largest unit of time is minutes;
the next largest unit of time is tens-of-minutes;
the next largest unit of time is hours;
the largest unit of time is tens-of-hours;
the preselected value of hundredths-of-seconds, tenths-of-seconds, seconds, minutes and hours units of time for incrementing the tenths-of-seconds, seconds, tens-of-seconds, tens-of-minutes and tens-of-hours units of time respectively, is ten; and
the preselected value of tens-of-seconds and tens-of-minutes units of time for incrementing the minutes and hours units of time, respectively, is six.

3. A circulating shift register time-keeping circuit as in claim 2 having 12 and 24 hour modes wherein:
the preselected value of the hours unit of time in the 12 hour mode for zeroing the tens-of-hours and resetting the hours units of time to a value of one is three; and
the preselected value of the hours unit of time in the 24 hour mode for zeroing the tens-of-hours and resetting the hours units of time to a value of one is five.

4. A circulating shift register memory as in claim 1 including a plurality of said storage means wherein:
one of the storage means is a real-time register having a 12 hour mode and 24 hour mode for storing time data representing real-time in units of hours, minutes, seconds and hundredths-of-seconds;
another of the storage means is a date register coupled to the real-time register for storing time data representing day of the week, and dates in units of the day of the month, month of the year and year of the century; and
another of the storage means is a stopwatch register having a first mode for storing time data representing split times in units of hours, minutes, seconds and hundredths-of-seconds and a second mode for storing time data representing split times in units of seconds and hundredths-of-seconds.

5. A circulating shift register time-keeping circuit as in claim 4 for use as an alarm signaling device wherein:
the storage means further includes an alarm register having an input and output port, a circulating shift register memory for storing preselected time data representing progressively larger units of time, and a comparator having input ports to receive time data from the storage means and coupled to the memory for continuously comparing time data therefrom with time data received from the storage means in response to timing and control signals from the timing and control means, respectively, and for providing an output signal at the output port when the time data from the storage means is equal to the preselected time data stored in the alarm register; and
the display means coupled to the output port of the alarm register for visually indicating when the output signal occurs thereat.

6. A circulating shift register time-keeping circuit as in claim 5 further including sensory means coupled to the output port of the alarm register for indicating when the electrical signal occurs thereat.

7. A circulating shift register time-keeping circuit as in claim 5 for use as a source of low frequency periodic signals wherein:
the stopwatch register is coupled to the output port of the alarm register for repetitively resetting to zero the time data incrementing in the stopwatch register when that data equals the preselected time data stored in the alarm register in response to the output signal received therefrom; and
the output port provides a low frequency periodic signal having a period approximately equal to the real time required for the time data incrementing in the stopwatch register to equal the time data stored in the alarm register.

8. A circulating shift register time-keeping circuit as in claim 7 for use as a source of asymetric timing signals wherein:
the alarm register is also coupled to at least one source of time data for successively replacing the time data stored in said alarm register when the time data incrementing in the stopwatch register is reset to zero in response to the output signal at the output port of the alarm register; and
the output port provides an asymetric timing signal having periods approximately equal to the real time required for the time data incrementing in the stopwatch register to equal the time data stored in the alarm register.

9. A real-time time data storage register comprising:
a circulating shift register memory for storing time data representing progressively larger units of time, said time data circulating therein at a preselected rate in response to timing signals provided thereto;
a binary adder coupled to the memory for incrementing the time data circulating therein;
an auxiliary register coupled to the binary adder for storing the incremented time data received therefrom;
an adder controller, coupled to the binary adder, the auxiliary register and responsive to timing and control signals for causing the binary adder to periodically increment the time data representing the smallest unit of time circulating in the memory, and to periodically increment the time data representing remaining progressively larger units of time circulating in the memory when the time data representing the largest preceding unit of time relative thereto equals preselected values, and for causing the auxiliary register to modify the value of the incremented time data stored therein when that time data equals said preselected values; and
an output port connected to the circulating shift register memory for coupling time data therefrom.

10. A real-time time data storage register as in claim 9 wherein:
the preselected rate of time data circulation is approximately 3.2 KHz:
the smallest unit of time is hundredths-of-seconds;
the next largest unit of time is tenths-of-seconds;
the next largest unit of time is seconds;
the next largest unit of time is tens-of-seconds;
the next largest unit of time is minutes;
the next largest unit of time is tens-of-minutes;
the next largest unit of time is hours;
the largest unit of time is tens-of-hours;
the preselected value of hundredths-of-seconds, tenths-of-seconds, seconds, minutes and hours units of time for incrementing the tenths-of-seconds, seconds, tens-of-seconds, tens-of-minutes and tens-of-hours units of time respectively, is ten; and the preselected value of tens-of-seconds and tens-of-minutes units of time for incrementing the minutes and hours units of time, respectively, is six.

11. A real-time time data storage register as in claim 10 having 12 and 24 hour modes wherein:

the preselected value of the hours unit of time in the 12 hour mode for zeroing the tens-of-hours and resetting the hours units of time to a value of one is three; and the preselected value of the hours unit of time in the 24 hour mode for zeroing the tens-of-hours and resetting the hours units of time to a value of one is five.

* * * * *

UNITED STATES PATENT OFFICE

CERTIFICATE OF CORRECTION

Patent No. 3,973,110 Dated August 3, 1976

Inventor(s) France Rode, Eric A. Slutz

It is certified that error appears in the above-identified patent and that said Letters Patent are hereby corrected as shown below:

In the Drawings, Figure 4, Sheet 7 of 11, add a connection dot to the intersection of the output of Gate 429 with the input of Gate 431 as shown below:

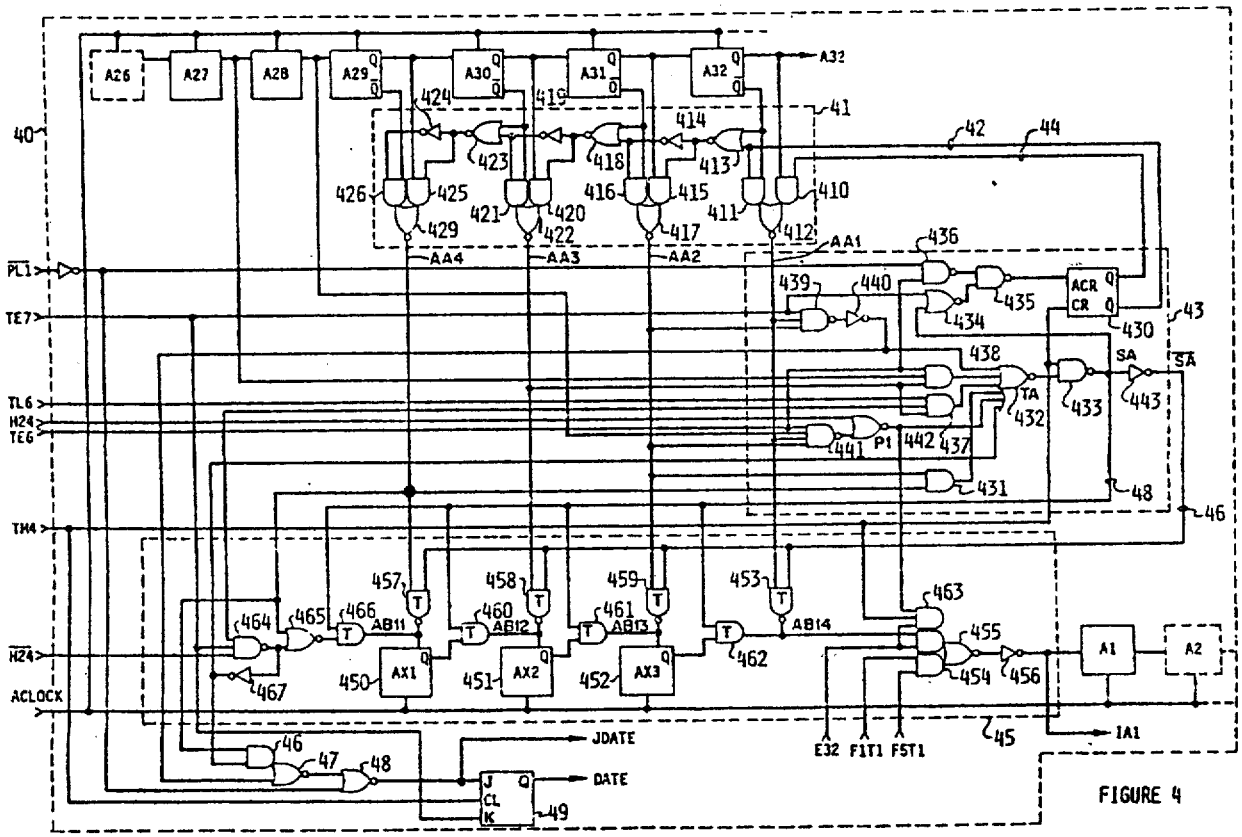

UNITED STATES PATENT OFFICE
CERTIFICATE OF CORRECTION

Patent No. 3,973,110 Dated August 3, 1976

Inventor(s) France Rode, Eric A. Slutz

It is certified that error appears in the above-identified patent and that said Letters Patent are hereby corrected as shown below:

Column 2, line 65, through column 3, line 33, Table 1 should read:

Table I

Controller Logic Equations

$$IS = ISCA + \overline{SYNC + DELAY}$$

$$LX1 = \overline{\overline{IS1 \cdot DS} + DS \cdot CS}$$

$$JXIS = \overline{LX1 \cdot ZJS + YIS + CS \cdot ZIS}$$

$$KXIS = 1$$

$$JYIS = \overline{ZIS \cdot LX1 + XIS + ZIS \cdot IS1 \cdot DS \cdot CS \cdot BS}$$

$$KYIS = \overline{XIS + TITE7}$$

$$JZIS = \overline{XIS + YIS + \overline{DS \cdot CS \cdot BS}}$$

$$KZIS = YIS \cdot KYIS + YIS \cdot LX1$$

$$CLXYZ = \overline{\overline{SYNCA \cdot XK1 \cdot XK4 \cdot PHASETWO + XK2 \cdot XK3 \cdot ZIS + \overline{ZIS\ XK2}}}$$

$$CLIS = \overline{\overline{SYNC + PHASETWO + XIS \cdot YIS}}$$

$$SETMD = \overline{\overline{DS + CS + YIS \cdot ZIS \cdot XIS + PHASETWO}}$$

$$MODE = \overline{\overline{YIS \cdot ZIS \cdot XIS + DS + CS}}$$

$$READ = \overline{\overline{YIS \cdot ZIS \cdot XIS + CS}}$$

$$DELAY = \overline{\overline{ZIS \cdot YIS \cdot ZIS}}$$

$$JTRN = \overline{\overline{READ \cdot DR3}}$$

$$KTRN = TITE\emptyset$$

$$CLTRN = SLOCK$$

UNITED STATES PATENT OFFICE

CERTIFICATE OF CORRECTION

Patent No. 3,073,110 Dated August 3, 1976

Inventor(s) France Rode, Eric A. Slutz

It is certified that error appears in the above-identified patent and that said Letters Patent are hereby corrected as shown below:

Table I continued:

$DHMS = DR1$ $CLHMS = \overline{\overline{MODE}+\overline{DR3}+DR2}$ $DH24 = DR1$ $CLH24 = \overline{\overline{MODE}+\overline{DR3}+\overline{DR2}}$ $DCOM1 = DR1$ $DCOM2 = DR2$ $CLCOML = \overline{\overline{MODE}+DR3}$ $SEAD = \overline{READ \cdot \overline{SLOCK}}$ $T1TC = \overline{COM1+COM2}$ $T2TC = \overline{\overline{COM1}+COM2}$ $T4TC = \overline{COM1+\overline{COM2}}$ $F1T1 = \overline{TRN \cdot \overline{DR1} \cdot DR2}$ $F5T1 = \overline{F1T1}$ $F2T2 = \overline{TRN \cdot DR1 \cdot \overline{DR2}}$ $F5T2 = \overline{F2T2}$ $F3T3 = \overline{TRN \cdot \overline{DR1} \cdot DR2+FIT3}$ $F5T3 = \overline{F3T3+FIT3}$ $F4T4 = \overline{TRN \cdot DR1 \cdot DR2}$ $F4T5 = \overline{F4T4}$ $F1T5 = \overline{\overline{SEAD}+DR1+DR2}$

UNITED STATES PATENT OFFICE

CERTIFICATE OF CORRECTION

Patent No. 3,973,110 Dated August 3, 1976

Inventor(s) France Rode, Eric A. Slutz

It is certified that error appears in the above-identified patent and that said Letters Patent are hereby corrected as shown below:

Table I continued:

$F2T5 = \overline{SEAD+DR1+DR2}$ $F3T5 = \overline{SEAD+DR1+\overline{DR2}}$ $F4T5 = \overline{\overline{SEAD}+\overline{DR1}+\overline{DR2}}$ $F5T5 = F5TE = \overline{TRN+SEAD}$ $FET5 = \overline{SEAD+\overline{TRN}}$ $FIT5 = F5TO = \overline{\overline{TRN}+DR4}$

Column 4, line 52, through column 5, line 6, Table II should read:

Table II

Time Base Logic Equations

$ECLOCK = \overline{READ \cdot PHASETWO \cdot \overline{XK3} \cdot XK5 \cdot XK6 + \overline{XK3} \cdot \overline{XK4} \cdot \overline{XK6} \cdot \overline{SLOCK}}$ $ACLOCK = \overline{SLOCK}$ $BCLOCK = \overline{SLOCK}$ $CCLOCK = \overline{SLOCK}$ $DCLOCK = \overline{SLOCK}$ $TM4 = \overline{XT1+XT2}$ $TE6 = \overline{XT3+\overline{XT4}+\overline{XT5}}$ $TE7 = \overline{\overline{XT3}+\overline{XT4}+\overline{XT5}}$ $TL6 = \overline{\overline{XT3}+\overline{XT4}+\overline{XT5}}$

UNITED STATES PATENT OFFICE

CERTIFICATE OF CORRECTION

Patent No. 3,973,110 Dated August 3, 1976

Inventor(s) France Rode, Eric A. Slutz

It is certified that error appears in the above-identified patent and that said Letters Patent are hereby corrected as shown below:

Table II continued:

$TE2 = \overline{XT3+\overline{XT4}+XT5}$ $TE\emptyset = \overline{XT3+XT4+XT5}$ $TE1 = \overline{XT5+XT4+\overline{XT3}}$ $TE3 = \overline{XT5+\overline{XT4}+\overline{XT3}}$ $TCOM = TE\emptyset \cdot \overline{TM4}+TM4 \cdot XT5+XT5 \cdot XT3+XT5 \cdot XT4$

JK FLIP-FLOP:

XT1 CLOCKED BY SLOCK

XT2 CLOCKED BY XT1

XT3 CLOCKED BY ST2

XT4 CLOCKED BY XT3

XT5 CLOCKED BY XT4

Column 6, line 18, "Q" should read -- $\overline{Q}$ --;

Column 7, line 48, after "AX2 to AX3" insert -- and AX3 --

Column 8, line 55, through column 9, line 19, Table III should read:

Table III

Real Time Register Logic Equations

| Gate Name | Logic Equation |
|---|---|
| AA1 | $= -(ACR \cdot A32+-ACR \cdot -A32)$ |

UNITED STATES PATENT OFFICE

CERTIFICATE OF CORRECTION

Patent No. 3,973,110 Dated August 3, 1976

Inventor(s) France Rode, Eric A. Slutz

It is certified that error appears in the above-identified patent and that said Letters Patent are hereby corrected as shown below:

Table III continued:

| | | |
|---|---|---|
| AA2 | = | -(AAA·A31+-AAA·-A31) |
| AA3 | = | -(AAB·A30+-AAB·-A30) |
| AA4 | = | -(AAC·A29+-AAC·-A29) |
| AAA | = | -(-A32+-ACR) |
| AAB | = | -(-A31+-AAA) |
| AAC | = | -(-A30+-AAB) |
| DACR | = | -(-(PL1·TE6)·-(TE7+SA)) |
| SA | = | -(TM4·TA) |
| TA | = | -(P1+P2+P3+(TE6·A27·AA3)+(AA2·AA4)+PPG) |
| P1 | = | -(H24+-(TE6·A28·AA1·AA2)) |
| P2 | = | TE7·AA1·AA2 |
| P3 | = | TE6·A27·AA3 |
| PPG | = | AA2·TE7·-H24 |
| PG | = | -(AA4+-PPG) |
| JDATE | = | -(PL1+-(P2+(AA4·PPG))) |
| ABI1 | = | PG·SA+AA4·-SA |
| ABI2 | = | AB1·SA+AA3·-SA |
| ABI | = | AB2·SA+AA2·-SA |
| ABI4 | = | AB3·SA+AA1·-SA |
| IA1 | = | P1·TM4·F1T1+ABI4·F1T1+E32·F5T1 |

UNITED STATES PATENT OFFICE

CERTIFICATE OF CORRECTION

Patent No. 3,973,110 Dated August 3, 1976

Inventor(s) France Rode, Eric A. Slutz

It is certified that error appears in the above-identified patent and that said Letters Patent are hereby corrected as shown below:

Table III continued:

| Flip-Flop Name | Type | Clock | Input Equation |
|---|---|---|---|
| ACR | D | TM4 | DACR |
| AB1 | D | A CLOCK | ABI1 |
| AB2 | D | A CLOCK | ABI2 |
| AB3 | D | A CLOCK | ABI3 |
| A1 | D | A CLOCK | IA1 |
| A[2:32] | D | A CLOCK | [An]←[An-1] |
| DATE | J/K | TM4 | J = JDATE |
| | | | K = TE7 |

Column 9, line 55, through column 10, line 9, Table IV should read:

Table IV

Stopwatch Register Logic Equations

| Gate Name | | Logic Equation |
|---|---|---|
| BB1 | = | -(-BCR·B32+BCR·-B32) |
| BB2 | = | -(BAA·B31+-BAA·-B31) |
| BB3 | = | -(BAB·B30+-BAB·-B30) |
| BB4 | = | -(BAC·B29+-BAC·-B29) |
| BAA | = | -(-B32+BCR) |
| BAB | = | -(-B31+-BAA) |

UNITED STATES PATENT OFFICE

CERTIFICATE OF CORRECTION

Patent No. 3,973,110 Dated August 3, 1976

Inventor(s) France Rode, Eric A. Slutz

It is certified that error appears in the above-identified patent and that said Letters Patent are hereby corrected as shown below:

Table IV continued:

BAC = -(-B30+-BAB)

BBI1 = -(BB4·-SB)

BBI2 = BB3·-SB+-BBB1·SB

BBI3 = BB2·-SB+BBB2·SB

BBI4 = BB1·-SB+BBB3·SB

DBCR = -(TE7+SB)

SB = -(TM4·TB)

TB = -(BB2·BB4+BB2·BB3·TL6·HMS)

IB1 = BBI4·F2T2+E32·F5T5

| Flip-Flop Name | Type | Clock | Input Equation |
|---|---|---|---|
| BCR | D | TM4 | DBCR |
| BBB1 | D | BCLOCK | BBI1 |
| BBB2 | D | BCLOCK | BBI2 |
| BBB3 | D | BCLOCK | BBI3 |
| B1 | D | BCLOCK | IB1 |
| B[2:32] | D | BCLOCK | [Bn]←[Bn-1] |

UNITED STATES PATENT OFFICE

CERTIFICATE OF CORRECTION

Patent No. 3,973,110 Dated August 3, 1976

Inventor(s) France Rode, Eric A. Slutz

It is certified that error appears in the above-identified patent and that said Letters Patent are hereby corrected as shown below:

Column 10, line 19, through line 33, Table V should read:

Table V

Alarm Register Logic Equations

| | | |
|---|---|---|
| IC1 | = | $\overline{F3T3 \cdot C32 + F5T3 \cdot E32 + FIT3 \cdot \overline{IN}}$ |
| ALS | = | $\overline{F1TC \cdot IA1 + F2TC \cdot IB1 + F4TC \cdot \overline{TCOM} \cdot ID1 + F3TC \cdot TCOM \cdot IA1}$ |
| JALARM | = | $\overline{IC1 \cdot ALS + IC1 \cdot \overline{ALS}}$ |
| KALARM | = | "0" |
| RALARM | = | TM4·TEØ·SYNCB |
| CLBUZ | = | TM4·TEØ+XK4+XK5 |
| SHIFT IN | = | CCLOCK+FIT5+FIT3 |
| RBUZ | = | MODE+RBZR |

FLIP-FLOP

| | |
|---|---|
| ALARM | CLOCKED BY CCLOCK |
| BUZ | CLOCKED BY CLBUZ |
| OUT F | CLOCKED BY CLBUZ |
| C1 to C32 | CLOCKED BY CLOCK |

UNITED STATES PATENT OFFICE

CERTIFICATE OF CORRECTION

Patent No. 3,973,110 Dated August 3, 1976

Inventor(s) France Rode, Eric A. Slutz

It is certified that error appears in the above-identified patent and that said Letters Patent are hereby corrected as shown below:

Column 11, line 39 through line 65, Table VI should read:

Table VI

Date Register Logic Equations

| Gate Name | | Logic Equation |
|---|---|---|
| DD1 | = | -(-DCR·D32+DCR·-D32) |
| DD2 | = | -(DAA·D31+-DAA·-D31) |
| DD3 | = | -(DAB·D30+-DAB·-D30) |
| DD4 | = | -(DAC·D29+-DAC·-D29) |
| DAA | = | -(DCR+-D32) |
| DAB | = | -(-DAA+-D31) |
| DAC | = | -(-DAB+-D30) |
| DDCR | = | -(DATE·TE6+JDATE·TE7+DD2·DD4+D28·DK+TE1·DD3+TE3·DD2) |
| TDD | = | -(TE1·DD3+TE3·DD2+DD2·DD4+DP1) |
| DP1 | = | D28·DK+TE7·DD4 |
| SD | = | -(TDD·TM4) |
| DK | = | -(PX1·PX2+PX1·PX3) |
| PX1 | = | -(DD1·DD2·TEZ) |
| PX2 | = | -(D27·TEO) |
| PX3 | = | -(DD2+(DD1·M31)) |
| CLM | = | TM4·TE2 |
| IM31 | = | -(D28·-DD1+-DD1·DD4+-D28·DD1·-DD4) |

UNITED STATES PATENT OFFICE

CERTIFICATE OF CORRECTION

Patent No. 3,973,110 Dated August 3, 1976

Inventor(s) France Rode, Eric A. Slutz

It is certified that error appears in the above-identified patent and that said Letters Patent are hereby corrected as shown below:

Table VI Continued:

DBI1 = -(DD4·-SD)

DBI2 = SD·-DB1+-SD·DD3

DBI3 = SD·DB2+-SD·DD2

DBI4 = SD·DB3+-SD·DD1

ID1 = DP1·TM4·F4T4+DBI4·F4T4+E32·F5T4

| Flip-Flop Name | Type | Clock | Input Equation |
|---|---|---|---|
| DCR | D | TM4 | DDCR |
| M31 | D | CLM | IM31 |
| DB1 | D | DCLOCK | DBI1 |

Columns 14 and 15, Digital Simulation System, line 15, No. 4, should read: DATE,ACR,AB[1:3],A[1:32], Columns 14 and 15, Digital Simulation System, line 16, No. 5, should read: PL1,H24,READ, Columns 14 and 15, Digital Simulation System, line 17, No. 6, should read: TIMM[6:1],SYNCA,QA1, Columns 14 and 15, Digital Simulation System, line 18, No. 7, should read: XKA,XKB,XK[6:1],XT[5:1],CT[3:1].

Columns 14 and 15, Digital Simulation System, line 25, No. 14, should read: JXK5,KXK5,JXK6,KXK6,SLOCK.

UNITED STATES PATENT OFFICE

CERTIFICATE OF CORRECTION

Patent No. 3,973,110 Dated August 3, 1976

Inventor(s) France Rode, Eric A. Slutz

It is certified that error appears in the above-identified patent and that said Letters Patent are hereby corrected as shown below:

Columns 14 and 15, Digital Simulation System, line 28, No. 17, should read: A[13]←1B1,A[18]←1B1,A[16]←1B1,A[20]←1B1, A[10]←1B1,A[12]←1B1, Columns 14 and 15, Digital Simulation System, line 29, No. 18, should read:
A[21]←1B1,A[24]←1B1,A[25]←1B1,A[28]←1B1,A[29]←1B1,A[32]←1B1], Columns 14 and 15, Digital Simulation System, line 55, No. 44, should read: AA1=-[A32*ACR+-A32*-ACR], Columns 14 and 15, Digital Simulation System, line 73, No. 62, should read: ↑TM4↑ACR←DACR., Columns 14 and 15, Digital Simulation System, line 74, No. 63, should read: A1=TM4*P1+AB14, Column 15, line 34, "*TIME=7A" should read -- *TIME=70--;

Column 15, line 39, "*TIME=399" should read -- *TIME=393 --;

Column 17, line 54, "*TIME=7059" should read -- *TIME=7359 --;

Column 17, line 56, "*TIME=7430" should read -- *TIME=7488 --;

Column 17, line 65, "*TIME=8060" should read -- *TIME=8068 --;

Column 31, line 2, "*TIME=10226" should read -- *TIME=13226 --;

UNITED STATES PATENT OFFICE

CERTIFICATE OF CORRECTION

Patent No. 3,973,110 Dated August 3, 1976

Inventor(s) France Rode, Eric A. Slutz

It is certified that error appears in the above-identified patent and that said Letters Patent are hereby corrected as shown below:

Column 31, line 18, "A-01001000" should read -- A=01004000 --;

Column 31, line 19, "*TIME-14328" should read -- *TIME=14323 --;

Column 31, line 93, "*TIME=19098" should read -- *TIME=19096 --;

Column 39, line 20, No. 59 should read -- SA=-(TM4*TA),SD=-(TM*TDD),SB=-(TM4*TB), Column 39, line 38, No. 77, should read: -- SLOCK*XT1*XT2*XT3 XT4_-XT4., --;

Column 39, line 39, No. 78, should read: -- SLOCK*XT1*XT2*XT3*XT4 XT5_-XT5., --;

Column 39, line 41, No. 80, should read: -- QA1=XT(=)2*A31*-A30*-A29*-A28*-A32*-A3*-A6, --;

Column 41, line 32 through Column 43, line 25, Digital Simulation System, should read:

```
DIGITAL SIMULATION SYSTEM

 1
 2      "TIMING,A,B,D REGISTER SIMULATION"
 3  REGISTER
 4      DATE,ACR,AB[1:3],A[1:32],D[1:32],DB[1:3],DCR,M31,
 5      PL1,H24,READ,B[1:32],BCR,BBB[1:3],HMS,
 6      TIMM[6:1],SYNCA,QA1,
 7      XKA,XKB,XK[6:1],XT[5:1],CT[3:1].
 8  TERMINAL
 9      JDATE,KDATE,AA[1:4],ABI[1:4],SR1,AI,AAA,AAB,AAC,SA,TA,PPG,P1,P2,P3
10      SYNC ,SYNCB,DACR,XKK,DDCR,SD,IM31,DK,DP1,DD[1:4],DAA,DAB,DAC,
11      ADCL,ECLOCK,ACLOCK,BCLOCK,CCLOCK,DCLOCK,DBI[1:4],DI,TDD,
```

UNITED STATES PATENT OFFICE
CERTIFICATE OF CORRECTION

Patent No. 3,973,110 Dated August 3, 1976

Inventor(s) France Rode, Eric A. Slutz

It is certified that error appears in the above-identified patent and that said Letters Patent are hereby corrected as shown below:

Digital Simulation System continued:

```
      PHASEONE,PHASETWO, CLX,JXK4,KXK4,
      TD[1:9],TEØ,TE2,TL6,TE7,TE6,TM4,TM1,TETTM4,TITE7, PX[1:3],TE1,TE3,
      JXK5,KXK5,JXK6,KXK6,SLOCK.
OPERATION
  SET=[DCR=1B1,BCR=1B1],
  LOAD=[
    ↑D[25:32](=)1↑D[29]=1B1,D[27]=1B1.,
    A[1]_1B1,A[4]_1B1,A[7]_1B1,A[8]_1BØ,
    A[13]_1B1,A[18]_1B1,A[16]_1B1,A[2Ø]_1B1,A[1Ø]_1B1,A[12]_1B1,
        B[21]_1B1,B[24]_1B1,B[25]_1B1,B[28]_1B1,B[29]_1B1,B[32]_1B1,
        A[21]_1B1,A[24]_1B1,A[25]_1B1,A[28]_1B1,A[29]_1B1,A[32]_1B1],
  GO=[
    TEØ=-XT5*-XT4*-XT3,
    TE1=-XT5*-XT4*XT3,
    TE2=-XT5*XT4*-XT3,
    TE3=-XT5*XT4*XT3,
    TL6=XT3*XT4+XT3*XT5,
    TE7=XT5*XT4*XT3,
    TE6=XT5*XT4*-XT3,
    TM4=XT2*XT1,
    TM1=-XT2*-XT1,
    TETTM4=XT5*XT4*XT3*XT2*XT1,
    TITE7=-(XT5*XT4*XT3*-XT2*XT1),
    AAA=-(-A32+-ACR), DAA=-(-D32+ DCR), BAA=-(-B32+ BCR),
    AAB=-(-A31+-AAA), DAB=-(-D31+-DAA), BAB=-(-B31+-BAA),
    AAC=-(-A3Ø+-AAB), DAC=-(-D3Ø+-DAB), BAC=-(-B3Ø+-BAB),
    AA1=-(A32*ACR+-A32*-ACR), DD1=-(D32*-DCR+-D32*DCR),
    AA2=-(A31*AAA+-A31*-AAA), DD2=-(D31*DAA+-D31*-DAA),
    AA3=-(A3Ø*AAB+-A3Ø*-AAB), DD3=-(D3Ø*DAB+-D3Ø*-DAB),
    AA4=-(A29*AAC+-A29*-AAC), DD4=-(D29*DAC+-D29*-DAC),
    BB1=-(B32*-BCR+-B32*BCR),  BB2=-(B31*BAA+-B31*-BAA),
    BB3=-(B3Ø*BAB+-B3Ø*-BAB),  BB3=-(B29*BAC+-B29*-BAC),
    P1=-(H24+-(TE6*A28*AA1*AA2)),
    P2=TE7*AA1*AA2,
    P3=TE6*A27*AA3,
    PPG= (AA2*TE7*-H24*TM4),
    TA=-(P2+P3+TL6*AA2*AA3+AA2*AA4+PPG+P1),
    IM31=-(-D28*DD1*-DD4+-D28*-DD1*DD4+-DD1*D28),
    ↑TM4*TE2↑M31_IM31.,
    PX1=-(DD1*DD2*TE2),
    PX2=-(D27*TEØ),
```

UNITED STATES PATENT OFFICE

CERTIFICATE OF CORRECTION

Patent No. 3,973,110 Dated August 3, 1976

Inventor(s) France Rode, Eric A. Slutz

It is certified that error appears in the above-identified patent and that said Letters Patent are hereby corrected as shown below:

Digital Simulation System continued:

```
      PX3=-(DD2+(DD1* M31)),
      DK=-(PX1*PX2+PX1*PX3),
      DP1=D28*DK+DD4*TE7,
      TDD=-(DD2*DD4+DP1+TE1*DD3+TE3*DD2),
      TB=-(BB2*BB4+BB2*BB3*TL6*HMS),
      SA=-(TM4*TA), SD=-(TM4*TDD), SB=-(TM4*TB),
      KDATE=TE7*TM4,
      JDATE=-(PL1+-(P2+(AA4*PPG)))*TM4,
      DATE_↑JDATE CON KDATE↑1DØ;1D1;-DATE;DATE.,
      ABI1=AA4*-SA+-(AA4+-PPG)*SA, DBI1=DD4*-SD,  BBI1=BB4*-SB,
      ABI2=AA3*-SA+AB1*SA,  DBI2=DD3*-SD+DB1*SD,  BBI2=BB3*-SB+BBB1*SB,
      ABI3=AA2*-SA+AB2*SA,  DBI3=DD2*-SD+DB2*SD,  BBI3=BB2*-SB+BBB2*SB,
      ABI4=AA1*-SA+AB3*SA,  DBI4=DD1*-SD+DB3*SD,  BBI4=BB1*-SB+BBB3*SB,
      DACR=-(-(PL1*TE6)*-(TE7+SA)),  DBCR=-(TE7+SB),
      DDCR=-(DATE*TE6+JDATE*TE7+DD2*DD4+D28*DK+TE1*DD3+TE3*DD2),
      ↑TM4↑ACR_DACR.,   ↑TM4↑DCR_DDCR.,   ↑TM4↑BCR_DBCR.,
      AI=TM4*P1+ABI4,   DI=TM4*DP1+DBI4,   BI=BBI4,
      SLOCK=1B1,
      ↑SLOCK↑AB1_ABI1, AB2_ABI2,AB3_ABI3,DB1_DBI1,DB2_DBI2,DB3_DBI3,
      BBB1_BBI1,BBB2_BBI2,BBB3_BBI3.,
      ↑SLOCK↑XT1_-XT1.,
      ↑SLOCK*XT1↑XT2_-XT2.,
      ↑SLOCK*XT1*XT2↑XT3_-XT3.,
      ↑SLOCK*XT1*XT2*XT3↑XT4_-XT4.,
      ↑SLOCK*XT1*XT2*XT3*XT4↑XT5_-XT5.,
      A_AI CON A[1:31],  D_DI CON D[1:31],   B_BI CON B[1:31],
      QA1=XT(=)2*A31*-A3Ø*-A29*-A28*-A32*-A3*-A6,
      ↑XT(=)3↑OUTPUT(6,B).
      ].
  CONTROL
      XAS:SET,->XA1/
      XA1:GO,->XA2/
      XA2:↑QA1↑->XA3;->XA1./
      XA3:LOAD,->XA1/.$

END OF TRANSLATION, Ø ERRORS.
```

UNITED STATES PATENT OFFICE

CERTIFICATE OF CORRECTION

Patent No. 3,973,110 Dated August 3, 1977

Inventor(s) France Rode, Eric A. Slutz

It is certified that error appears in the above-identified patent and that said Letters Patent are hereby corrected as shown below:

Column 45, line 1, delete "tenths-of" (second occurrence).

Signed and Sealed this

Thirty-first Day of May 1977

[SEAL]

*Attest:*

RUTH C. MASON
*Attesting Officer*

C. MARSHALL DANN
*Commissioner of Patents and Trademarks*